US006141948A

United States Patent [19]

Brazeau

[11] Patent Number: 6,141,948

[45] Date of Patent: Nov. 7, 2000

[54] APPARATUS FOR MAKING TWISTED WIRE

[75] Inventor: Michel Brazeau, Montreal, Canada

[73] Assignee: Lefebvre Freres Ltd, Montreal, Canada

[21] Appl. No.: 09/048,840

[22] Filed: Mar. 27, 1998

[30] Foreign Application Priority Data

Apr. 4, 1997 [CA] Canada ..... 2201849

[51] Int. Cl.[7] ..... D01M 1/10

[52] U.S. Cl. ..... 57/58.65; 57/58.49; 57/58.82; 57/58.67; 57/67; 242/364.12; 242/365.3; 242/472.4; 242/484

[58] Field of Search ..... 57/58.49, 58.52, 57/58.61, 58.65, 58.67, 58.7, 58.72, 58.83, 67; 242/364.12, 365, 365.3, 472.6, 484

[56] References Cited

U.S. PATENT DOCUMENTS

| | | | |
|---|---|---|---|
| 3,348,369 | 10/1967 | Burr | 57/58.7 |
| 3,753,342 | 8/1973 | Yoshitake et al. | 57/71 |
| 3,791,131 | 2/1974 | Scott et al. | 57/161 |
| 3,867,809 | 2/1975 | Holbrook | 57/58.52 |
| 4,050,640 | 9/1977 | Henrich | 242/25 R |
| 4,164,331 | 8/1979 | Henrich | 57/71 |
| 4,182,104 | 1/1980 | Sukle | 57/58.57 |
| 4,235,070 | 11/1980 | Bravin | 57/71 |
| 4,339,909 | 7/1982 | Godderidge | 57/58.52 |
| 4,397,141 | 8/1983 | Gurecki | 57/58.59 |
| 4,471,161 | 9/1984 | Drummond | 174/110 R |
| 4,599,853 | 7/1986 | Varga-Papp | 57/9 |
| 4,756,149 | 7/1988 | Preussner | 57/71 |
| 5,557,914 | 9/1996 | Maccaferri | 57/58.67 |

FOREIGN PATENT DOCUMENTS

| | | | |
|---|---|---|---|
| 0 732 441 | 9/1996 | European Pat. Off. . | |
| 47-38017 | 9/1972 | Japan | 57/58.7 |

*Primary Examiner*—William Stryjewski
*Attorney, Agent, or Firm*—Brouillette, Kosie

[57] ABSTRACT

An apparatus for the manufacture of twisted wire from two or more feed wires, whereby the twisted wire is taken up onto a take up spool, the take up spool being axially reciprocatingly displaceable along its longitudinal axis and wherein the take up spool is not rotatably driven about its longitudinal axis. The feed wires are advanced through the apparatus by a capstan configured and disposed to be axially aligned with the twisting means of the apparatus.

17 Claims, 12 Drawing Sheets

APPARATUS FOR MAKING TWISTED WIRE

FIELD OF THE INVENTION

The present invention relates generally to industrial machinery, specifically to wire assembly machines for the manufacture of twisted wire from two or more feed wires, whereby the twisted wire is taken up onto a take up spool.

BACKGROUND OF THE INVENTION

Wire assembly machines are known. Machines alternatively known as stranders, twisters, cablers, bunchers, twiners etc . . . have been in existence for a number of years. These machines are used to combine a plurality of individual wires (or cables, strands, filaments etc . . . ) and twist them together by imparting a single, double or more twists to them, in order to produce a twisted wire. Once the twisting operation is complete, the twisted wire is taken up, deposited, wound up, payed off, etc . . . onto a rotationally driven take up spool.

Known stranding machine designs are generally characterized by the take-up spool (i.e. the spool where the final product or twisted wire is wound up, wrapped, or coiled up) being rotationally driven about its axis in order to effect, in whole or in part, the take-up of the twisted wire onto the take up spool. Once the wires have been twisted, the take up (or pay off, wounding up, wrapping up or coiling up of the take up spool) usually begins, whereby the leading end of the twisted wire is advanced onto the take up spool, which is then made to rotate by the application of rotational force.

Known machines may operate at relatively high speed, whereby the wires are advanced through the machine at relatively high speeds and the take up of the twisted wire onto the rotating take up spool is also effected at relatively high speeds. Such designs are disclosed in a number of patents, namely U.S. Pat. Nos. 4,397,141 by Gurecki, 4,599,853 by Varga-Papp, 3,791,131 by Scott, 4,182,104 by Sukle.

In accordance with known systems, the diameter and the mass of the roll of twisted wire loaded onto the take up spool changes constantly as the loading operation is progressing.

This necessitates a constantly changing energy requirement to rotate the take up spool. At the start of the loading operation, the take-up spool is empty and the wire is first deposited on the take-up spool with a low level of rotational energy required to rotate the take-up spool. As more wire is deposited, the take-up spool gradually fills, therefore gradually becoming heavier. Therefore, by the end of the loading operation, a much greater rotational force may be required to rotated the take up spool.

The rotational force required to rotate the take spool may therefore be significant. This may particularly be true near the end of the loading operation, especially for large take up spools, as the mass of all the twisted wire deposited on the take up spool has to be rotated. Thus as may be appreciated, the energy requirement necessary to rotate the take up spool may not be constant, as it may vary from the beginning of the loading operation to the end of the loading operation.

In addition, the take up spool of present machine designs may become unstable i.e. wobble, during the loading operation. The changing mass of the take-up spool coupled with the high rotational speeds of the take up spool may make it difficult to properly balance the take up spool. This is especially true for large take up spools operating at high velocity. In addition to rotating about their axis, take up spools may also themselves oscillate, for example about an axis which is off-centre. Thus present machine designs may be made which may be able to withstand wobbly, unbalanced and unstable rotating coils. In addition, present machine designs may also be able to withstand the constantly changing rotational moment of the take-up spool, from a small moment at the start of the loading operation to a potentially large moment near the end of loading operation.

In addition, during the loading operation, if an emergency braking situation occurs, the take-up spool with its varying mass may be difficult to control since the braking forces needed to be applied may vary depending on whether the take-up spool is close to empty or close to full. Braking mechanisms able to withstand large braking forces may thus be required.

Some of the operating characteristics of known machine designs may therefore require larger, heavier and more expensive parts and components to counter the large rotational moment created by a heavy mass rotating at high speed. This may therefore increase the cost of manufacture, purchase and installation of such a machine. The size of the motors or drives needed to rotationally drive the take-up spool may also be sufficiently large to rotationally drive a take up spool that will increase in size and weight during loading.

In addition, as present machine designs may be subjected to greater and changing rotational dynamic loads, they may wear out more quickly, which may increase the cost of servicing, maintaining and replacing the machines.

Machines of known design may further be designed such that the configuration of the layout of the advancing means i.e. such as a capstan member, is such that the capstan is disposed on a cradle, or is disposed such that it is itself rotated or oscillated (in addition to rotating about its own axis). As a consequence, present designs may be costly and difficult to manufacture. In addition, as the level of complexity to dispose and install the capstan in known designs may be relatively high, it is often difficult to effectively transmit power to them, which may result in loss of efficiency. In addition, the configuration of known capstan design may often require a large number of complex and costly parts and components.

In addition, the layout of the advancing means, i.e. for example the capstan member, of present machine designs may make it difficult to modify the speed of the advancing means during the loading operation, such that the operational range and efficiency of present machines may be affected.

It would therefore be advantageous to have an apparatus which would obviate the need for a rotationally driven take up spool.

It would further be advantageous to have an apparatus which would obviate the need for a capstan which is configured and disposed on an axis eccentric the axis of rotation of the apparatus.

It would therefore be advantageous to have for an apparatus which would reduce the manufacturing cost thereof. It would therefore be advantageous to have provide for an apparatus which would reduce the operating costs thereof, maintenance cost thereof.

STATEMENT OF INVENTION

The present invention generally relates to machinery, specifically to a apparatus for manufacturing twisted wire from two or more individual feed wires. The apparatus may be configured such that once the twisting operation is complete, the take up action of the twisted wire onto a take up spool may be facilitated by using a spool configured and disposed to be non rotatable about said longitudinal axis when said twisted wire is being taken up onto said take up spool. The apparatus may alternatively be configured such that once the twisting operation is complete, the take up action of the twisted wire onto a take up spool may be facilitated by the axially reciprocatingly motion of the take up spool in combination with the winding motion of the twisted wire about the take up spool. The apparatus may also be configured and disposed to include a capstan which is coaxially aligned with the axis of rotation of the twisting means.

In accordance with a general aspect, the present invention provides a method of winding wire onto a take up spool comprising winding said wire about said take up spool having a longitudinal axis;

reciprocatingly displacing said take up spool along said longitudinal axis in combination with the winding of said wire when said wire is taken up onto said take up spool.

In accordance with a further general aspect the present invention provides for:

an apparatus for taking up wire onto a take up spool having a longitudinal axis, said apparatus comprising means for taking up said wire onto said take up spool such that said wire is wound thereabout, reciprocating means for reciprocatingly displacing said take up spool along said longitudinal axis when said twisted wire is taken up onto said take up spool.

In accordance with a further general aspect of the present invention, there is provided for in an apparatus for making twisted wire from a plurality of feed wires being advanced therethrough, said apparatus comprising twisting means for imparting at least one twist (e.g. two or more twists) to said plurality of feed wires so as to obtain said twisted wire, means for taking up said twisted wire onto a take up spool such that said twisted wire is wound thereabout, said take up spool having a longitudinal axis, the improvement wherein said take up spool is reciprocatingly displaceable along said longitudinal axis and wherein said apparatus includes reciprocating means for inducing a reciprocating movement of said take up spool along said longitudinal axis when said twisted wire is taken up onto said take up spool.

In accordance with a further general aspect of the present invention, there is provided for in an apparatus for making twisted wire from a plurality of feed wires, said apparatus comprising wire advancing means for advancing said plurality of feed wires through said apparatus, twisting means for imparting at least one twist (e.g. two or more twists) to said plurality of feed wires, said twisting means comprising a first twist component being rotatable about a first axis such as to define a space volume, means for taking up said twisted wire onto a take up spool such that said twisted wire is wound thereabout, the improvement wherein said wire advancing means comprises a capstan configured and disposed to be rotatable about a second axis coaxially aligned with said first axis of rotation.

In accordance with a further embodiment of the present invention there is provided an apparatus wherein said advancing means comprises a capstan driving means configured and disposed so as to be exterior of said space volume, said capstan driving means being operatively connected to said capstan so as to be able to rotationally drive said capstan.

In accordance with a further embodiment, there is provided for an apparatus wherein said capstan is configured and disposed so as to be encompassed within said space volume.

In accordance with a further aspect, the present invention provides for:

in an apparatus for making twisted wire from a plurality of feed wires being advanced therethrough, said apparatus comprising twisting means for imparting at least one twist (e.g. two or more twists) to said plurality of feed wires so as to obtain said twisted wire, means for taking up said twisted wire onto a take up spool such that said twisted wire is wound thereabout, said take up spool having a longitudinal axis, the improvement wherein said take up spool is reciprocatingly displaceable along said longitudinal axis and wherein said apparatus includes reciprocating means for inducing a reciprocating movement of said take up spool along said longitudinal axis when said twisted wire is taken up onto said take up spool.

Further in accordance with a particular aspect of the present invention, there is provided for in an apparatus for making twisted wire from a plurality of feed wires being advanced therethrough, said apparatus comprising twisting means for imparting at least one twist (e.g. two or more twists) to said plurality of feed wires so as to obtain said twisted wire, means for taking up said twisted wire onto a take up spool such that said twisted wire is wound thereabout, said take up spool having a longitudinal axis, the improvement wherein said take up spool is reciprocatingly displaceable along said longitudinal axis and is configured and disposed to be rotatable about said longitudinal axis and wherein said apparatus includes reciprocating means for inducing a reciprocating movement of said take up spool along said longitudinal axis when said twisted wire is taken up onto said take up spool.

And in accordance with yet a further aspect of the present invention, there is provided for:

in an apparatus for making twisted wire from a plurality of feed wires being advanced therethrough, said apparatus comprising twisting means for imparting at least one twist (e.g. at least two twists) to said plurality of feed wires so as to obtain said twisted wire, means for taking up said twisted wire onto a take up spool such that said twisted wire is wound thereabout, said take up spool having a longitudinal axis, the improvement wherein said take up spool is reciprocatingly displaceable along said longitudinal axis and is configured and disposed to be non rotatable about said longitudinal axis when said twisted wire is being taken up onto said take up spool and wherein said apparatus includes reciprocating means for inducing a reciprocating movement of said take up spool along said longitudinal axis when said twisted wire is taken up onto said take up spool.

In accordance with the present invention, the expression non rotatable about said longitudinal axis when said twisted wire is being taken up onto said take up spool is not to be taken to mean that the take up spool may not be rotatably mounted i.e. it may be rotatably mounted. Thus, for example, the take up spool may be rotatably mounted on a support shaft through bearings or other friction reducing means. In accordance with this configuration, the support shaft may be rotated at a given rotational speed but the presence for example of bearings means makes it such that the take up spool is not necessarily rotated therewith. Although the take up spool may therefore be free to rotate about its axis i.e. be free floating when it is being wrapped thereabout with the twisted wire, it may be provided with suitable means to keep it substantially from oscillating about its axis, such as by the presence of suitably disposed counter weights. It is understood however, that the take up or winding action of the twisted wire itself onto the take up spool during the loading operation may impart a certain rotational moment to the take up spool, which may be partially or fully counter balanced by counterweights suitably affixed to the take up spool so as to inhibit and counter balance a rotational moment.

The take up spool, in accordance with this aspect of the invention, may also be rotatable about its longitudinal axis. It is understood that in accordance with this aspect, the take up spool may be fixed with respect to its longitudinal axis (i.e. fixed to a rotatable support shaft), which means that the spool would rotate with the support shaft which would also be rotated. In this case the apparatus would be suitably modified so as to not defeat the purpose of the invention.

The take up spool may have any suitable structure or form configured to facilitate the winding thereon of the twisted wire. The take up spool may for example comprise two opposed flat (circular) disks spaced apart by an elongated cylindrical core having an axis disposed centrally therethrough. The take up spool may comprise a longitudinal axis which may be coaxial with the axis of the core. It is understood that the take up spool may have any required or desired configuration and shape to suit the needs of taking up, or taking up thereon the twisted wire.

The take up spool may also comprise a shaft having a longitudinal axis, onto which the take up spool may be removably attached through any suitable means. The longitudinal axis of the shaft may be parallel to the longitudinal axis of the take up spool, and may also be coaxially aligned with the longitudinal axis of the take up spool. The take up spool may be suitably attached to the spool shaft through any suitable means.

An apparatus for making twisted wire in accordance with the present invention, may comprise as mentioned above, reciprocating means. The reciprocating means may act on the take up spool in order that the take up spool is displaced in an axially reciprocating movement parallel, or substantially parallel, to the longitudinal axis of the take up spool. The reciprocating means may displace the take up spool between a first position and a second position.

The reciprocating means may comprise one or more motors (electric, hydraulic, etc . . . ), drives, and other means, such as ball screws, ACME™ screws, THOMPSON shafts, pillow blocks, hydraulic pistons, pneumatic pistons etc . . . to effect the axially reciprocating movement of the spooling means. Thus for example, the reciprocating means may comprise a reversible speed electrical motor which may be operationally connected to a drive belt, which may in turn be operationally connected to ball screw means, which may comprise a carriage unit. The carriage unit of the ball screw means may in turn be operationally connect to a shaft, onto which may be releasably affixed the take up spool. When required or desired, the reversible speed motor is activated, which may cause, through the described arrangement, the take up spool to be displaced along its longitudinal axis. Once the required or desired displacement has been achieved, a suitably configured limit switch means such as a Siemens PROXIMITY SENSOR or other control device may be triggered in a known manner which may cause a signal to be received by the reversible speed motor which may make the reversible speed motor reverse its direction. The reversible speed motor may then apply force in the reverse direction, again through the described arrangement. Once the required or desired displacement has been achieved in this opposed direction, a further limit switch means or other control device may be triggered which may cause a further signal to be received by the reversible speed motor which may make the reversible speed motor reverse its direction once more. This cycle may be repeated the required or desired number of times. It is understood that the reciprocating means may axially reciprocatingly displace the spooling means at a constant or varying speeds, as desired or required, and that the speed of the reciprocating movement may be varied during the take up operation of the twisted wire onto the take up spool. It is understood that the reciprocating means may include the required or desired number of suitable bearings, bushings and other supports as well as any additional mechanical, electrical, control and other systems, such as braking means, required or desired so as to achieve the required reciprocating motion through the reciprocating means.

Axially reciprocating movement is understood to mean that the take up spool may be displaced, through the action of the reciprocating means, along a given axis (such as for example, along the longitudinal axis of the take up spool) for a certain distance. Following the completion of this displacement, the direction of the take up spool is reversed, such that the take up spool is now displaced in substantially the opposite direction to the first direction, along substantially the same axis, for a certain distance. Once this cycle is complete, it may be repeated for any number of desired or required cycles, therefore creating the reciprocating movement. The distance displaced in one direction may or may not be equal to the distance displaced in the opposed direction, and it is understood that the respective distances may be varied during the loading operation. It is further understood that the axis of movement in one direction may also for example, not be exactly coaxial, nor parallel with the axis of movement in the other direction.

The twisting means in accordance with the present invention may comprise a number of configurations. An example configuration of the twisting means may comprise a double twist configuration whereby the plurality of wires being advanced through the apparatus may be imparted with two twists. Further configurations whereby any given number of twists, i.e triple twist, quadruple twist, etc . . . are imparted to the wires may also be employed. The twisting means may comprise a twisting component configured and disposed so as to be rotated about an axis which is substantially horizontal. It is to be understood however that such twisting component may be rotated about an axis other than horizontal, i.e for example vertical. If desired, the twisting means may comprise a number of different components each of which is configured such that each of these components may impart a separate twist to the plurality of wires, each separate component being rotatable about an axis that is substantially horizontal, or if desired or required, other than horizontal, i.e. for example vertical. It is understood that the twisting means may include the required or desired number of suitable bearings, bushings and other supports as well as any additional mechanical, electrical, control and other systems, such as braking means, required or desired so that the purpose of the twisting means is not defeated. In addition, the twisting means may be supported on a required or desired number of suitable shafts, links, etc . . . , which may be powered by a required or desired number of motors (electric, hydraulic, etc . . . ), drives, and other transmission means.

Individual wires to be twisted may be fed to the apparatus from supply spools or other supply means which may be integral with the apparatus or which may be stand alone units remote from the wire assembly machine. The apparatus may then transform the individual wires which are fed from the supply spools into twisted wire, through an operation alternatively known as stranding, bunching, twisting, cabling or other. The apparatus may impart one twist or two or more twists, in which latter case the twists may be continuously imparted at two or more successive positions. In accordance with the present invention, it is understood that the apparatus may impart a required number of twists, (i.e. one, two, three or more) onto two, three, four or more wires, cables etc, as required or desired.

In accordance with the present invention, there is provided as mentioned above, means for taking up the twisted wire onto a take up spool. The take up means may comprise a tension flyer disposed downstream from the twisting mean, i.e. after the twisting means. The tension flyer may be configured and disposed such that it may be made to rotate about the longitudinal axis of the take up spool and may be used for the winding of the twisted wire about the take up spool. Thus after the twisting is accomplished, the twisted wire may be further advanced onto the tension flyer, such that the rotational movement of the tension flyer may cause the twisted wire to be deposited or wound onto the take up spool.

The take up (i.e. coiling, paying off, winding, etc . . . ) of the twisted wire onto the take-up spool (i.e. after the plurality of wires have been twisted) may therefore, be effected by the winding movement of the twisted wire about the take up spool. The winding movement may be effected by the means for taking up said twisted wire onto the take up spool, namely the tension flyer. It is understood that other means in place of or in addition to said tension flyer may be employed, which may provide for the winding of the twisted wire about the take up spool. The take up of the twisted wire onto the take up spool may also be facilitated by the axially reciprocatingly movement of the take up spool, which reciprocating movement may be induced by the reciprocating means to effect a combined movement with the twisting means.

Therefore, the actual deposit of the twisted wire may be effected through the rotating motion of the tension flyer about the take up spool, in combination with the axially reciprocating movement of the take up spool. At the start of the loading operation of the twisted wire onto the take up spool, the tension flyer may begin to rotate about the take up spool. As the tension flyer continues its rotation about the take up spool, the first row of the first layer of twisted wire may be caused to be deposited onto the take up spool, i.e. for example onto the cylindrical core of the take up spool. As the twisting means continues rotating about the take up spool, the take up spool is concurrently and simultaneously displaced substantially along the longitudinal axis of the take up spool a distance sufficient to allow the tension flyer to deposit a second row of twisted wire adjacent the first row of twisted wire just previously deposited. The concurrent axial displacement of the take up spool along its longitudinal axis is effected by the reciprocating means, as previously described.

The above described sequence is continued a required or desired number of times, such that the take up spool is further axially displaced a required or desired distance, which allows the tension flyer, which continues to rotate about the take up spool, to deposit additional rows of twisted wire on the core of take up spool.

In accordance with an alternative configuration of the present invention, it is understood that the take up spool may be non displaced in the longitudinal axial direction. Thus the tension flyer, in addition to rotating about the take up spool, may be displaceable in a direction substantially parallel to the longitudinal axis of the stationary take up spool. Therefore, in this configuration, a suitable reciprocating means through appropriate modifications, may act on the tension flyer in order to axially reciprocatingly displace the tension flyer in a manner substantially parallel to the longitudinal axis of the stationary take up spool. Therefore, in this configuration, the take up of the twisted wire onto the take up spool is effected through the combined and coordinated movements of the rotating action of the tension flyer, and of the axially reciprocating action of the same tension flyer.

Thus, in the context of the present invention, reciprocatingly displacing the take up spool along its longitudinal axis in relation to the tension flyer is understood to comprise either the reciprocating movement of the take up spool in relation to the tension flyer or the reciprocating movement of the tension flyer in relation to the take up spool.

In accordance with the present invention, the take up of the twisted wire on the take up spool may be effected by the rotating motion of the tension flyer about the take up spool, as described above, in combination with a combined axially reciprocation displacement of both the take up spool and the tension flyer relative to each other. In accordance with this configuration, the axial reciprocating movement of the take up spool and the twisting means may be coordinated to effect the necessary reciprocating displacement of the take up spool. Thus in this configuration, the reciprocating means, through appropriate modifications, may act on both the tension flyer and the take up spool.

In accordance with the present invention, the take up of the twisted wire on the take up spool may be effected by the rotating motion of the tension flyer about the take up spool, as described above, in combination with the axially reciprocating displacement of the wire assembly machine, or substantial parts thereof, including the twisting means and the tension flyer, in relation to the take up spool.

It is understood that the speed of rotation of said tension flyer may remain constant throughout the loading operation or may vary in accordance with the operational requirements or the loading operation.

In accordance with an additional aspect of the present invention, an apparatus for making twisted wire from a plurality of feed wires, may comprise wire advancing means for advancing said plurality of feed wires through said apparatus.

The wire advancing means may comprise a capstan, which capstan may be used to facilitate the advancing of the (feed) wires through the apparatus.

In accordance with the present invention an advancing means may comprise a capstan driving means configured and disposed so as to be operatively connected to a capstan so as to be able to rotationally drive said capstan, the capstan driving means may for example be disposed exterior or substantially exterior of a space volume.

In accordance with the present invention a capstan may be configured and disposed so as to be encompassed within said space volume.

The advancing means may facilitate the advancing of the plurality of wires through an apparatus. The advancing means may comprise a capstan configured and disposed so as to be rotatable about an axis which may be substantially coaxial with the axis of rotation of said twisting means. If the apparatus is a double twist machine, the capstan may be rotatable about an axis which is substantially coaxial with the axis of rotation of a component of the first of the two twist means. It is understood, that if required or desired, the capstan may alternatively be rotatable about an axis which is substantially coaxial with the axis of rotation of the second of the two twist means. The capstan may be disposed so as to be encompassed within above mentioned space volume defined by the rotational movement of the twisting means.

In accordance with the present invention, the advancing means may comprise capstan driving means configured and disposed exterior or substantially exterior of the above mentioned space volume. The capstan driving means may be operationally connected to the capstan member, in order that the capstan may be driven by the capstan driving means such that the capstan may rotate about its axis. For example, the capstan driving means may comprise a capstan shaft operationally connected to the capstan. The capstan driving means and, the capstan may be suitably mounted on and supported by the apparatus through appropriate bearings, bushings or any other mechanical systems and or friction reducing means. In addition, the capstan shaft or the capstan may be connected to the capstan driving means through appropriate transmission means, for example pulleys, gears, belts, shafts, and other force transmission means, each may be adequately mounted on and supported by the apparatus through appropriate bearings, bushings or any other mechanical systems and or friction reducing means. The capstan driving means may for example comprise one or more motors, wether electric, hydraulic, variable speed or other in order to rotatably drive the capstan. It is further understood that the present configuration may also include all other required or desired mechanical, electrical, control and measurement means, braking means and other systems to give effect to the advancing means of the present invention and such that the purpose and intent of the present invention is not defeated. The capstan driving means may not be integral with nor be part of the apparatus and may be physically located remote from the wire assembly machine. The capstan and the capstan driving means may be operationally driven independently from the remaining components and means of the wire assembly machine, namely the twisting means, the means for take up, and others.

In accordance with a further additional aspect of the present invention, there is provided:

A double twist apparatus for making double twisted wire from a plurality of feed wires, comprising:

wire advancing means for advancing said plurality of feed wires through said apparatus;

first twist means for imparting a first twist to said plurality of feed wires;

second twist means for imparting a second twist to said plurality of feed wires subsequent to said first twist;

take up means for taking up said twisted wire onto a take up spool, such that said twisted wire is wound about said take up spool, said take up spool having a longitudinal axis and being axially reciprocatingly displaceable along said longitudinal axis;

reciprocating means for inducing a reciprocating movement of said take up spool along said longitudinal axis when said twisted wire is taken up onto said take up spool;

said first twist means comprising an arcuate arm member having opposed ends, said arcuate arm member being rotatably mounted at each said opposed end such that said arcuate arm member is rotatable about a common axis so as to define a space volume, said take up means comprising a tension flyer rotatable about a first axis, said first axis being coaxially aligned with said common axis, said take up means being configured and disposed such that said tension flyer is encompassed within said space volume, said take up spool being configured and disposed to be non rotatable about said longitudinal axis when said twisted wire is being taken up onto said take up spool, said wire advancing means comprising a capstan configured and disposed to be rotatable about a second axis coaxially aligned with said common axis, and wherein said advancing means includes capstan driving means operatively connected to said capstan so as to be able to rotationally drive said capstan.

An apparatus in accordance with the present invention may comprise a machine frame of suitable design and construction taking into consideration its purpose of supporting and of holding in relative position the various components and means thereof. The first twist means may comprise an arcuate arm member having opposed ends, each of said opposed ends may be rotatably mounted so as to be able to rotated about a common axis. It is understood that common axis may not obligatorily mean an identical or same physical axis, but may mean that the first opposed end is rotated about an axis that is coaxial with the axis about which the second opposed end is rotated. Each of said opposed end of the arcuate arm member may be rotationally mounted on a distinct arcuate arm member sleeve shaft. In addition the rotational motion of the arcuate arm member may define a first space volume.

The arcuate arm member and the respective arcuate arm member sleeve shafts may be supported by the machine frame through the use of a suitable number and type of bearings, bushings or other mechanical or friction reducing means, keeping in mind their purpose of providing anchorage and support and of allowing rotational movement thereof. The arcuate arm member sleeve shafts may be hollow. The first twist means may be rotatably driven by a suitable means, such as for example electric, hydraulic, variable speed motors, etc . . . , and may also be provided with the required or desired power transmission and other mechanical devices, such as for example belts, gears, drives, links, etc . . . The first twist means may also be provided with all required control systems and other systems, such as braking means. The first twist means may also comprise the appropriate type and number of pulleys and guides arranged in a known configuration to assist in the imparting of the first twist to said plurality of feed wires.

In accordance with the present invention, a second twist means may comprise a second twist shaft which may be operatively connected to one of the opposed ends of the arcuate arm member, through for example, a connecting plate, or other suitable manner. The connecting plate may be mounted on or attached to a suitable support shaft, such as for example, an arcuate arm member sleeve shaft, which arcuate arm member may be rotatably mounted and rotatably driven. The second twist shaft and the arcuate arm member may for example be rotatable at the same speed. The second twist means may further comprise a transmission means mounted on the second twist shaft, which purpose is to transmit rotational force from the second twist shaft to a third twist shaft. This configuration allows for the second twist shaft and the third twist shaft to be rotated at the same or different speeds, as required or desired. The transmission means may comprise any desired or required configuration, such as for example a gear box, motor, etc . . . In a particular embodiment, the transmission means may be configured and disposed such that the second twist shaft and the third twist shaft are substantially coaxially aligned such that it may appear as though the second twist shaft and the third twist shaft are unitary. The transmission means may, in accordance with this particular configuration, comprise an electro-magnetic brake, such as a HYSTERISIS brake, which through the use of electro-magnetic forces may act as a brake to slow the rotational speed of the third twist shaft. Thus as may be understood, the purpose, of the transmission means is to enable the third twist shaft to have a different rotational speed than the second twist shaft, i.e. each side of the said transmission means has a shaft which may rotate at different speeds, in order that the rotational speed of the third twist shaft may be lower than (or equal to) the velocity of the second twist shaft. The second twist means may also comprise a required number and type of pulleys and guides in order to assist in the imparting of the second twist to the plurality of feed wires, in a known manner, (which have already been twisted once by the first twist means) being advanced therethrough. In addition, the second twist means may be provided with a required number and type of bearings, bushings, and other mechanical and support means, in addition to electrical and control systems.

A transmission means may also double as a tension control means which may participate in the controlling of the tension present in the feed wires or twisted wires. It is understood that in addition to a Hysterisis™ brake, other control means may be included.

The second twist means may be configured and disposed such that it may be encompassed within the space volume defined by the rotational movement of a rotatable first twist component. As may be understood, the axis of rotation of the second twist means may be substantially coaxial with the common axis.

The take up means may comprise a tension flyer which is mounted onto the third twist shaft, such that the axis of rotation of the tension flyer may be coaxially aligned with the common axis of the arcuate arm member. Thus the rotational speed of the tension flyer may be controlled, in whole or in part, by the action of the transmission means, namely the Hysterisis™ brake. The Hysterisis brake is activated and controlled in known manner. The tension flyer may be configured as an L' shaped member, but it is understood that any required or desired shape may be employed, such as for example a U' shaped member. The tension flyer may also be provided with a required and desired number of pulleys, and guides which assist in the guiding of the now twisted wire therethrough.

Also in accordance with the present configuration, a double twist apparatus may be provided with advancing mean, which advancing mean may comprise a capstan which may advance, in whole or in part, the plurality of feed wires through the said double twist apparatus. The advancing means may thus comprise a capstan configured and disposed so as to be rotatable about an axis which is substantially coaxial with the axis of rotation of the first twist means, i.e. the common axis. In addition, the capstan may be disposed so as to be encompassed within the first space volume defined by the rotational movement of the first twist means.

Thus in accordance with the present configuration, the advancing means may also comprise capstan driving means configured and disposed exterior of the first space volume defined by the rotational movement of the first twist means. The driving means may be operationally connected to the capstan, in order that the capstan is to be rotationally driven by the capstan driving means such that the capstan may rotate about its axis. For example, the capstan may be connected to the capstan driving means through a capstan shaft, said capstan shaft may be rotationally mounted on and supported by the apparatus through appropriate bearings, bushings or any other mechanical systems and or friction reducing means. In addition, the capstan shaft may be connected to the capstan driving means through appropriate pulleys, gears, belts and other force transmission means, each adequately mounted on and supported by the apparatus through appropriate bearings, bushings or any other mechanical systems and or friction reducing means. The capstan driving means may also comprise a motor, wether electric, hydraulic, variable speed or other in order to drive the capstan. It is further understood that the present configuration may also include all required or desired control and measurement means, braking means and other systems to give effect to the present invention and such that the purpose and intent of the present invention is not defeated.

Thus the capstan driving mean may be located, in whole or in part, exterior of the space volume defined by the rotational movement of the twisting means. It is understood that if required or desired, the capstan driving means may not be integral with nor be part of the apparatus and may be physically located remote from the wire assembly machine. As may be understood, the capstan and the capstan driving means may be operationally driven independently from the remaining components and means of the wire assembly machine, namely the twisting means, the means for take up, and others.

As may also be understood, the capstan may be rotated by a capstan shaft about an axis which is coaxial with the axis of rotation of the arcuate arm member. Thus, the capstan shaft may be configured and disposed so as to be disposed within the hollow arcuate arm shaft (as described ante) which allows for the disposition within the arcuate arm member, in a coaxial manner, of the capstan shaft. As may be understood, the two shafts thus rotate one inside the other. In accordance with this configuration, the capstan shaft and the arcuate arm shaft are provided therebetween with a required or desired number and type of bearings, bushings or other mechanical or friction reducing means, such that one shaft may freely rotate about the other, and such that both shafts are not in contact. In addition, said bearing means also my allow the capstan shaft and the arcuate arm member shaft to partially support each other, i.e. in bending moment and shear, while at the same time not interfere with the other's independent rotation.

In accordance with the present configuration, the capstan and at least a portion of the capstan shaft may be configured and disposed to be within the space volume defined by the rotational movement of the arcuate arm member. Thus, the capstan may be configured and disposed such that the first twist means, including the arcuate arm member, rotates about and encompasses the capstan. Thus as may be understood, the capstan may be disposed adjacent one of the opposed ends of the arcuate arm member.

The capstan shaft is mounted on the machine support frame such that the machine support frame may anchor, support and hold in position the capstan axis through the use of bearing means and other anti friction means.

In accordance with a particular configuration, the second twist shaft of the second twist means may be affixed to the distal end of the capstan such that the second twist shaft is coaxially aligned with the capstan shaft. In this manner, the rotation of the capstan may also cause the rotation of the second twist shaft.

The present configuration of the double twist apparatus may also comprise a take up spool. The take up spool may be removably mounted on a support shaft, said support shaft being aligned substantially parallel and coaxially with the common axis of the arcuate arm member. The take-up spool may be configured and disposed such that, when the tension flyer is rotated by the second twist shaft, the tension flyer may rotate about the take up coil, such that the space volume defined by the rotational motion of the tension flyer encompasses at least part of the take up spool. As defined previously, the take up spool may be non rotating.

In addition, the double twist apparatus, in accordance with this present configuration, may comprise reciprocating means. The reciprocating means may act on the take up spool in order that the take up spool is displaced in an axially reciprocating movement coaxial with the longitudinal axis of the take up spool.

The reciprocating means may comprise one or more motors (electric, hydraulic, etc . . . ), drives, and other means, such as ball screws, Acme screws, Thompson shafts, pillow blocks, hydraulic pistons, pneumatic pistons etc . . . to effect the axially reciprocating movement of the spooling means. Thus for example, the reciprocating means may comprise a reversible speed electrical motor which may be operational connected to a drive belt, which may be in turn operational connected to a ball screw. The carriage unit of the ball screw may in turn be operationally connect to a shaft which may be connected to the take up spool. When required or desired, the reversible speed motor is activated, which may cause, through the described arrangement, the take up spool to be displaced along its longitudinal axis. Once the required or desired displacement has been achieved, a limit switch or other control device may be triggered which may cause a signal to be received by the reversible speed motor which may make the reversible speed motor reverse its direction. The reversible speed motor may then apply force in the reverse direction, again through the described arrangement. Once the required or desired displacement has been achieved in this opposed direction, a further limit switch or other control device may be triggered which may cause a signal to be received by the reversible speed motor which may make the reversible speed motor reverse its direction once more. This cycle may be repeated the required or desired number of times. It is understood that the reciprocating means may axially reciprocatingly displace the spooling means at a constant or varying speeds, as desired or required, and that the speed of the reciprocating movement may be varied during the take up operation of the twisted wire onto the take up spool.

It is understood that the reciprocating means may include the required or desired number of suitable bearings, bushings and other supports which may be supported on the machine frame, as well as any additional mechanical, electrical, control and other systems, such as braking means, required or desired so that the purpose of the invention is not defeated.

Thus in accordance with a particular aspect, the machine frame may take any desired or required form, keeping in mind its purpose of providing support, stability and rigidity to an industrial machine. Said machine frame may be generally configured and disposed so as to provide attachment points for various components and means of the wire assembly machine. The material of construction of said machine frame may be steel, but it is understood that any other type of material and/or combination of materials may be employed if desired or required.

Also in accordance with a particular aspect of the present invention, the apparatus may comprise a required number of pulleys and guides in order to effectively advance and guide the plurality of feed wires and the twisted wire. The apparatus may also comprise the necessary number of gages, switches and other controls, to effectively monitor and control the various functions and steps of the wire assembly machine. The apparatus may also comprise effective braking mechanisms to allow for routine or emergency braking of the twisting operation. The apparatus may also comprise the required drives, motors and others to effectively power the twisting operation. Thus in accordance with the present invention, the double twist apparatus may be fed with a plurality of feed wires from feed spools which may be provided separately from the double twist apparatus. The individual feed wires may be advanced through the double twist apparatus, in whole or in part, by the capstan, such that the rotation of the capstan may cause the pulling along of the feed wires. As the feed wires are being advanced, they may be advanced along the arcuate arm member, such that the rotation of the arcuate arm member may impart the first twist onto said feed wires. Once the first twist has been imparted, the partially twisted feed wires are further advanced through the second twist means, such that the second twist may be imparted, onto the partially twisted wires. Following which the twisted wire is further advanced to the tension flyer, which as previously described is rotatable about the take up spool. At this point the twisted wire is ready to be wound up and taken up on the take up spool, through the combined rotational motion of the tension flyer and the axially reciprocating motion of the take up spool, as described herein above.

Generally in accordance with the present invention, there is provided for a apparatus which may be suitable for a variety of industrial applications in the fields of manufacturing electrical wires, conductors, cables, steel tire cord, steel rope, steel cables, rope or other. The apparatus of the present invention may also be suitable for use in any other applications where any threadlike material, such as wire, rope, or cable of any material, such as aluminum, copper, brass, etc . . . are required or needed to be stranded, twisted or otherwise combined in a generalized twisting motion. In addition the present invention may be suitable for applications where the supply material may be strand like or filiform fibres such as synthetic fibres i.e. nylon, or others, or natural fibres such as wool, cotton, silk, or others. The present invention may also be suitable for applications where a combination of types of cables and materials are to be stranded, twisted or other, such as insulated wire, cable, etc., which may be twisted in combination with non insulated wire.

It is also understood that the present invention may also be suitable for applications of winding cables, wires, ropes etc . . . onto a take up spool regardless of wether they have been twisted, stranded, or otherwise combined. Thus the apparatus may, for example, be used to wind a single untwisted wire onto a take up spool.

Thus in accordance with a further embodiment of the present invention there is provide for a method of winding wire from a wire assembly apparatus onto a take up spool comprising rotating said wire about said take up spool, said take up spool having a longitudinal axis;

reciprocatingly displacing said take up spool along said longitudinal axis in combination with the rotating of said wire in order to effect the winding of the wire onto said take up spool.

Thus in accordance with this additional embodiment, a method of taking up twisted wire from a wire assembly apparatus, whereby wire is payed off onto a take up spool. Thus the wire is made to be rotated about a take up spool, which said take up spool may be non rotated. The take up spool is axially reciprocatingly displaced along its longitudinal axis, said movement being combined with the rotation movement of the wire about the take up spool.

BRIEF DESCRIPTION OF THE DRAWINGS

Example embodiments of the invention are illustrated by way of example only in the accompanying drawings.

DETAILED DESCRIPTION OF THE DRAWINGS

Figure 1:
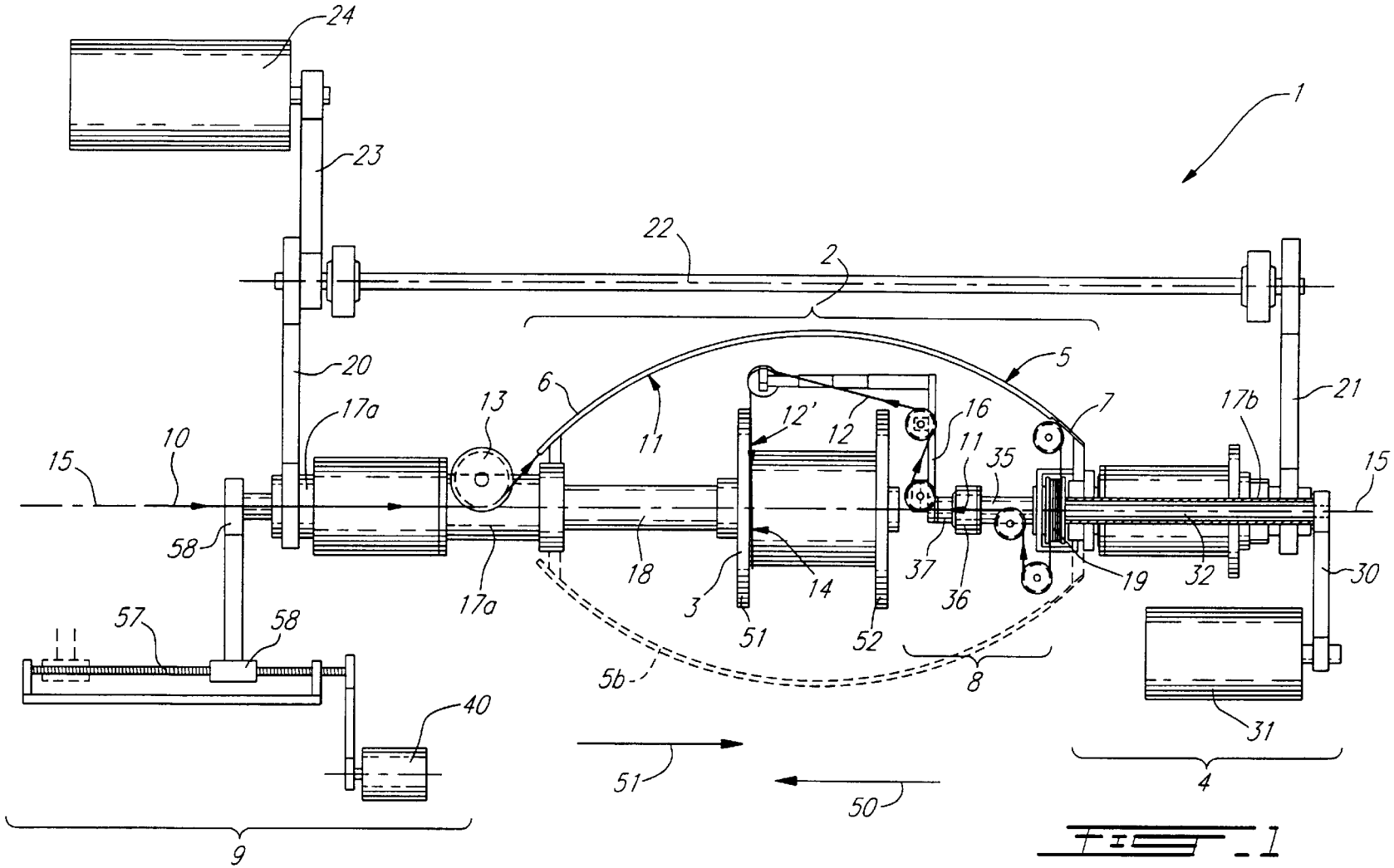
FIG. 1 is an example embodiment a front elevation schematic view of an apparatus in accordance with the present invention, showing an apparatus for making twisted wire comprising twisting means, wire advancing means, take up spool (in the fully extended position) and reciprocating means.

FIG. 1 shows a schematic illustration of an apparatus 1 in accordance with the present invention, comprising twisting means comprising a first twist means generally indicated at 2, and a second twist means generally indicated at 8, take up spool generally indicated at 3, wire advancing means generally indicated at 4, reciprocating means generally indicated at 9 and a plurality of feed wires, generally indicated at 10, to be twisted, etc . . . by the apparatus 1. Although not shown, a plurality of feed wire spools from which the plurality or wires are to be fed to the apparatus 1 in a known manner are provided and may be generally located to the left of the apparatus as shown in FIG. 1. In addition, a required number of suitable guide pulleys and other guiding mechanisms (not shown) are to be arranged principally to the left of the apparatus 1 (as shown in FIG. 1) in order to effectively direct the plurality of wires 10 to the apparatus 1 of FIG. 1 in a known manner. A machine support frame, as well as suitable bearing means, breaking means, control means, electrical supply and connections is provided but not shown.

In addition, pulley means to effectively guide the plurality of feed wires 10 as well as intermediate wires 11 (i.e. which have been imparted with one twist) and twisted wires 12 (i.e. which have been imparted with two twists) through the apparatus 1. Pulley means to assist in the imparting of the required twists are also provided, some of which are shown, for example, pulley 13 which forms part of first twist means 2, and which assists in the imparting of the first twist onto feed wires 10 in a known manner, in combination with the rotation of the first twist means 2.

The example embodiment of FIG. 1 comprises first twist means generally indicated at 2 comprising an arcuate arm member 5, and pulley 13. The arcuate arm member 5 is shown as having a generally arcuate shape comprising opposed ends 6 and 7, each of which is rotatably mounted so as to be rotatable about a common axis, generally indicated at 15. The rotational mountings of the opposed ends 6 an and 7 will be described with respect to FIG. 4 for opposed end 7 and with respect to FIG. 6 for opposed end 6. Therefore, as may be understood from FIG. 1, the arcuate arm member 5, when the apparatus 1 is in operation, is to be rotatably driven about axis 15 such that the arcuate arm member 5 defines a space volume. Said space volume encompasses take up spool 3, as well as encompasses tension flyer 16. Second twist means, generally indicated at 8 also comprises tension flyer 16. Tension flyer 16 is configured and disposed to be shaped in a generalized L' shape and is rotationally mounted so as to be rotated about common axis 15. It is understood however that the tension flyer 16 may be configured and disposed to have a different shape, such as for example a U' shape. The rotational mounting of tension flyer 16 will be described herein below in relation to FIG. 4. Therefore, as may be understood from FIG. 1, the second twist means 8, when in operation, rotates about axis 15 and in the process rotationally drives tension flyer 16, which rotates about and encompasses take up spool 3. As may be apparent form FIG. 1, arcuate arm member 5 also rotates about and encompasses capstan 19.

Figure 7:
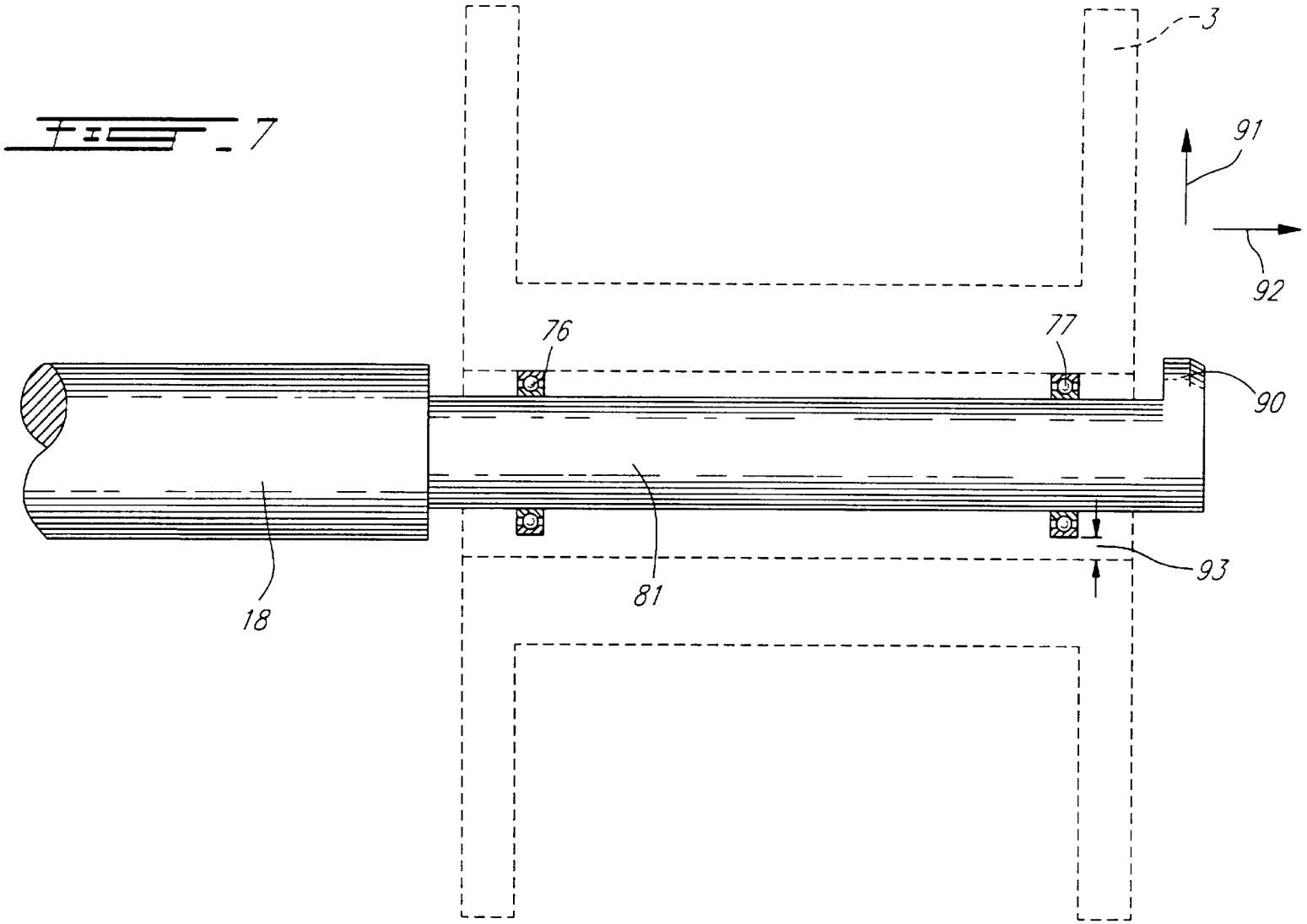
FIG. 7 is a schematic longitudinal sectional view of a take up spool showing a means of attachment of the take up spool onto the spooling shaft.

The take up spool 3 is removably affixed onto shaft 18 such that the removal of the take up spool 3 from the shaft 18 is possible when required or desired or at the end of the loading operation. Turning to FIG. 7, there is shown a cross section of take up spool 3 rotatably mounted onto spooling shaft 81. Edge lip 90 is provided at the furthest most extremity of mounting shaft 75 so as to provide an actual restraint on the take up spool 3. It is understood that whenever a take up spool 3 is removed from the shaft 18, another take up spool 3, of a same or different size and configuration may be replaced in its place. The longitudinal axis of the shaft 18 is shown as being coaxial with the axis of the take up spool 3, although it is understood that the axis of the take up spool 3 may not obligatorily be coaxially aligned with the axis of the shaft 18. In the embodiment shown in FIG. 1, the axis of the take up spool 3 is coaxial with the common axis 15. Although this is the preferred embodiment, it is understood that the axis of the take up spool 3 may be aligned otherwise than coaxially with the common axis 15.

Advancing means generally indicated at 4 comprises a capstan 19, a capstan shaft 32, and a motor 31 which is operationally connected to capstan shaft 32 by drive belt 30. The capstan 19 is configured and disposed such that it is to be rotatably driven by the capstan shaft 32 via the motor 31, such that it is rotatable about the longitudinal axis of the capstan shaft 32, which in the embodiment shown in FIG. 1 is to be substantially coaxial with the common axis 15. The advancing means 4, in accordance with this particular embodiment facilitates the advancing of the plurality of feed wires, generally indicated at 10, and intermediate wires generally indicated at 11 etc . . . through the twisting means.

The reciprocating means is generally indicated at 9, and comprises a reversible electric motor 40 and ball screw means 57 comprising carriage unit 58, the whole suitable for causing the axially reciprocatingly displacement of the take up spool 3 along its longitudinal axis. Thus the reciprocating means 9 may axially displace the take up spool 3 in the direction of motion arrows 50 or 51 for a desired or required distance, for example from a first position to a second position. Once the take up spool 3 has been displaced a required or desired distance, the reciprocating means 9 causes the take up spool 3 to be displaced in the opposite direction, i.e. opposite the direction of motion arrow 50, such as for example along motion arrow 51. For any particular reciprocating cycle comprising a movement in a first direction, for example along motion arrow 50, and a movement in the opposite direction, for example along motion arrow 51, the distances in each direction may not be the same.

The plurality of feed wires to be advanced through the apparatus 1 are generally indicated at 10 and are shown being advanced through the apparatus 1 from feed spools to the left of FIG. 1 (not shown). The plurality of intermediate wires generally indicated at 11 are shown having been partially advanced through the apparatus 1 and partially through the first twist means 2. The plurality of twisted wires, generally indicated at 12, are shown having been further advanced through the apparatus 1, namely past the second twist means 8. The twisted wire, generally indicated at 12', is shown having been advanced yet further through the apparatus 1 and is shown ready to be taken up on the take up spool 3. As may be apparent, the tension flyer 16 guides the twisted wire 12' and induces winding of the twisted wires 12' about the take up spool 3. The rotational motion of the tension flyer 16 about the take up spool 3 therefore causes the take up of the twisted wire 12' onto the take up spool 3. Twisted wire 14 is shown having been actually deposited on the take up spool 3.

Arcuate arm member 5 is rotationally driven about common axis 15 by belts 20 and 21 each acting respectively on opposed ends 6 and 7 of the arcuate arm member 5 through arcuate arm member sleeve shafts 17(*a*) and 17(*b*). The motor 24 drives belt 23 which is connected to and drives belt 20 as well as is connected to and drives belt 21 through connecting shaft 22. The advancing means 4, comprising the capstan 19 is rotated by motor 31 which drives belt 30, in turn rotating capstan shaft 32. Support bearings and other suitable mechanical elements are provided (not shown).

The second twist means 8 comprises a second twist shaft 35, a third twist shaft 37 and a transmission means 36, namely a Hysterisis™ brake. The second twist shaft 35 and the third twist shaft 37 are configured and disposed so as to be substantially coaxially aligned, such that they may each rotate about common axis 15. The Hysteresis™ brake operationally connects second twist shaft 35 to third twist shaft 37 and is configured and disposed such that it may be made to vary the rotational speed of third twist shaft 37 such that the speed of third twist shaft 37 may be less than or equal to the rotational speed of the second twist shaft 35. Intermediate wire 11 is advanced such that it may pass through the centre of the Hysterisis™ brake, as shall further be explained with respect to FIG. 4. The tension flyer 16, is affixed onto the third twist shaft 37 and as may be apparent, the axis of rotation of said tension flyer 16 is coaxially aligned with the axis of rotation of the third twist shaft 37 (and with the axis of rotation of second twist shaft 35) which is coaxially aligned with common axis 15. Tension flyer 16 fixed to third twist shaft 37 such that the rotational movement of third twist shaft 37 induces the rotational movement of tension flyer 16.

It is understood that drive belts 20, 21, 23 and 30 may be substituted if desired or required for mechanical or other equivalent alternatives, such as sprockets, direct drives or other means.

The driving mechanisms for the aforementioned first twist means 2 and advancing means 4, namely motor 24 and motor 31 and their corresponding shafts, supports, bearings etc . . . are configured such that arcuate arm member 5, pulley 13, capstan 19, second twist means 8 and tension flyer 16 may each be rotated about common axis 15. However, the speed of rotation of the various components may be different, for example, the rotation speed of arcuate arm member 5 may be slower than the rotating speed of the capstan 19. Tension flyer 16 may rotate at the same speed as third twist shaft 37, but this rotational speed may be slower than the rotating speed of the second twist shaft 35, which is interconnected thereto by the Hysterisis brake. Motors 24 and 31 may be direct drive motors, variable speed motors, or alternatively may be AC or DC motors.

As may be seen, first twist means 2 may (optionally) be provided with a counter balance arm partially shown at 5(*b*) in dotted outline opposite the arcuate arm member 5. The optional counter balance arm 5(*b*) may not be provided in all embodiments of the present invention. The purpose of optional counter balance arm 5(*b*) is to provide a counter balance to the arcuate arm member 5 such that the rotation of arcuate arm member 5, especially at high velocity may not un-balance or destabilize the apparatus 1.

Figure 2:
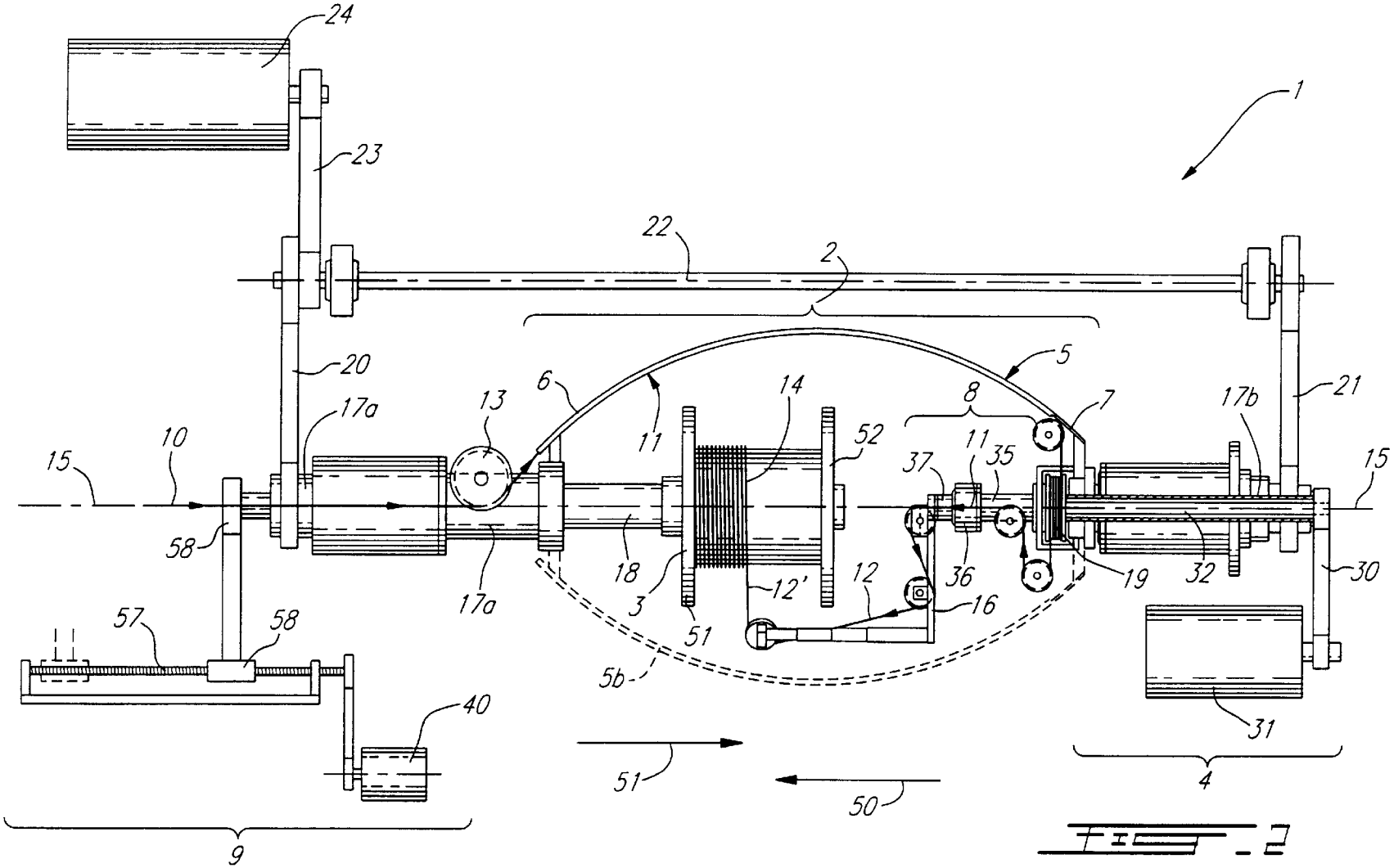
FIG. 2 is a front elevation view of the example embodiment of FIG. 1 showing a further position of the tension flyer, and showing as well the take up spool having been axially longitudinally displaced to an intermediate position.

Turning to FIG. 2, there is shown the apparatus 1 of FIG. 1 where the second twist means, generally indicated at 8 onto which tension flyer 16 is affixed, is shown in a differently rotated position, i.e. approximately 180° from the position shown in FIG. 1. It may thus be seen by FIG. 2, when compared to FIG. 1, the manner in which tension flyer 16 rotates about common axis 15, and also about the take up spool 3. Take up spool 3, is also shown having been axially displaced in the direction of motion arrow 50, therefore showing the manner in which take up spool 3, is axially displaceable along the axis of the shaft 18. As shown in FIG. 2, the position of take up spool 3 is shown, for illustration purposes, as being approximately halfway between the position of the take up spool 3 shown in FIG. 1 and the position of take up spool 3 shown in FIG. 3, i.e. halfway between a first position and a second position. Also, carriage unit 58 is shown to have been displaced in the direction of motion arrow 50. The take up spool 3 is shown as being partially filled with at least one partial layer of twisted wire 14, the tension flyer 16 having been rotated at least a number of times in order to have deposited onto take up spool 3 the amount of twisted wire 14 shown.

Figure 3:
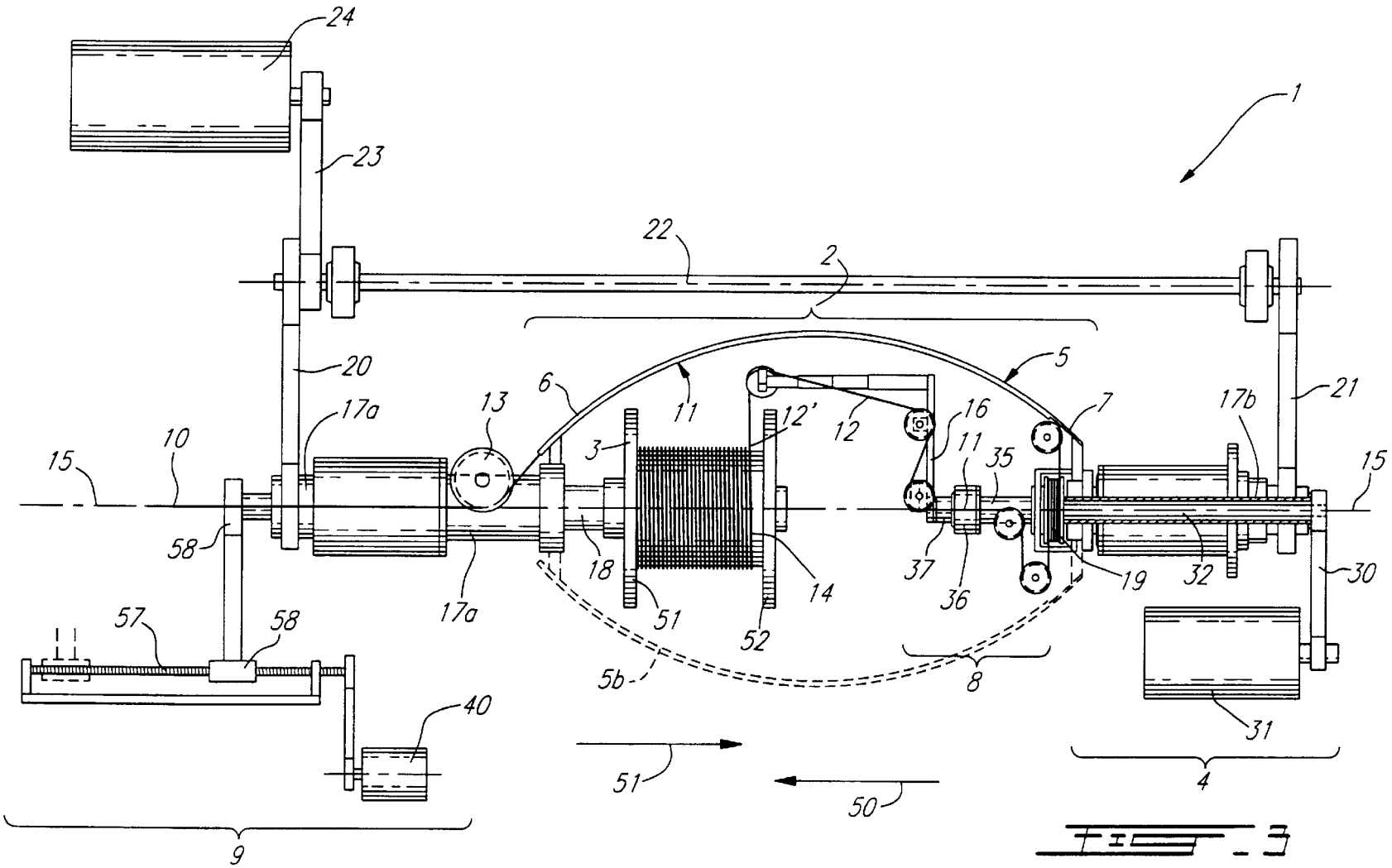
FIG. 3 is a front elevation view of the example embodiment of FIG. 1 showing a further position of the tension flyer, and showing as well the take up spool having been further axially longitudinally displaced to a retracted position.

Turning to FIG. 3 there is shown the apparatus 1 of FIG. 1 where the second twist means, generally indicated at 8 from which tension flyer 16 is affixed, is shown in an further rotated position, i.e. approximately 180° from its position shown in FIG. 2 and approximately back to the position as shown in FIG. 1. In addition the take up spool 3 has been further axially displaced in the direction shown by motion arrow 50. Also, carriage unit 58 is shown to have been further displaced in the direction of motion arrow 50. Take up spool 3 is further shown as having had deposited thereon additional twisted wire 14, the tension flyer 16 having been rotated at least a further number of times in order to have deposited onto take up spool 3 the amount of twisted wire 14 shown.

FIGS. 1 through 3 therefore each show a partial sequence of rotation of the tension flyer 16, and a partial sequence of axial displacement of take up spool 3, and a partial sequence of axial displacement of carriage unit 58. From the embodiment shown, it may be recognized that the take up spool 3 attached to shaft 18 is not rotated about its axis during the winding process. The reciprocating means generally described at 9 imparts onto take up spool 3 only translational movement along the axis of shaft 18, (which, as described above, is coaxially aligned with the longitudinal shaft of take-up spool 3, and common axis 15). Thus the take up spool 3, is axially reciprocatingly driven in the direction of motion arrows 50 and 51 while at the same time is not directly rotationally driven by apparatus 1.

As may be apparent from the above, the take up of the twisted wire 14 onto the take up spool 3 is effected through the combined and coordinated motions of the axially reciprocatingly displaced take up spool 3 and the rotated tension flyer 16 rotated thereabout.

The take up of the twisted wire 14 onto take-up spool 3 may therefore best be illustrated from the sequence of FIGS. 1 through 3. It is understood however that FIGS. 1 through 3 depict only a part sequence (for laying down a single layer of twisted wire 14) in the loading operation of the take up spool 3, namely the axial displacement of the take up spool 3 in one direction, as indicated by motion arrow 50. However it is understood that the axial displacement of the take up spool 3 is also reciprocated along motion arrow 51 in order to lay down a second layer of twisted wire 14. FIG. 1 shows the take-up spool 3 having been axially displaced along its longitudinal axis in the direction of motion arrow 50 to approximately the furthest position along said longitudinal axis. FIG. 1 shows, as an example, the take up spool 3 as being substantially empty of twisted wire 13, and thus being at or nearly at the beginning of the loading operation. In FIG. 1, the twisted wire 14 is shown being deposited on take-up spool 3 adjacent first opposed disc 51 of the take-up spool 3, although it is understood that the loading operation may begin depositing twisted wire 14 anywhere on the take up spool 3, such as for example near the second opposed disc 52. Once the twisted wire 12' has been advanced through the apparatus 1 to the take up spool 31 the tension flyer means 16 is caused to be rotated about its axis, which is coaxial with common axis 15, such that a first row of twisted wire 14 is deposited onto the take up spool 3. As the tension flyer 16 continues to rotate about the take up spool 3, the take up spool 3 is axially displaced along the longitudinal axis of the shaft 18 in the direction of motion arrow 50, a distance sufficient to allow the tension flyer 16 (which is continuing its rotational motion about the take up spool 3) to deposit a second row of twisted wire 14 on the take up spool 3. The distance which the take up spool 3 is advanced may be adjusted as a function of the speed of rotation of the tension flyer 16, the thickness of the twisted wire 13, the required density of twisted wire 14 on the take up spool 3 and any other operational constraint.

In FIG. 2, a possible next sequential step in the loading operation of the take up spool 3 there is shown the take up spool 3 having been further axially displaced along the longitudinal axis of the shaft 18 in the direction of motion arrow 50. As may be understood, the tension flyer 16 will have been rotated about the take up spool 3 a number of times as the take up spool 3 was being progressively advanced such that an additional number of rows of twisted wire 14 have been deposited on take-up spool 3.

In FIG. 3, there is shown take up spool 3 having been axially displaced further still along the longitudinal axis of the shaft 18 in the direction of motion arrow 50. such that the twisted wire 13 is being deposited on take-up spool adjacent second opposed disc 52.

Figure 4:
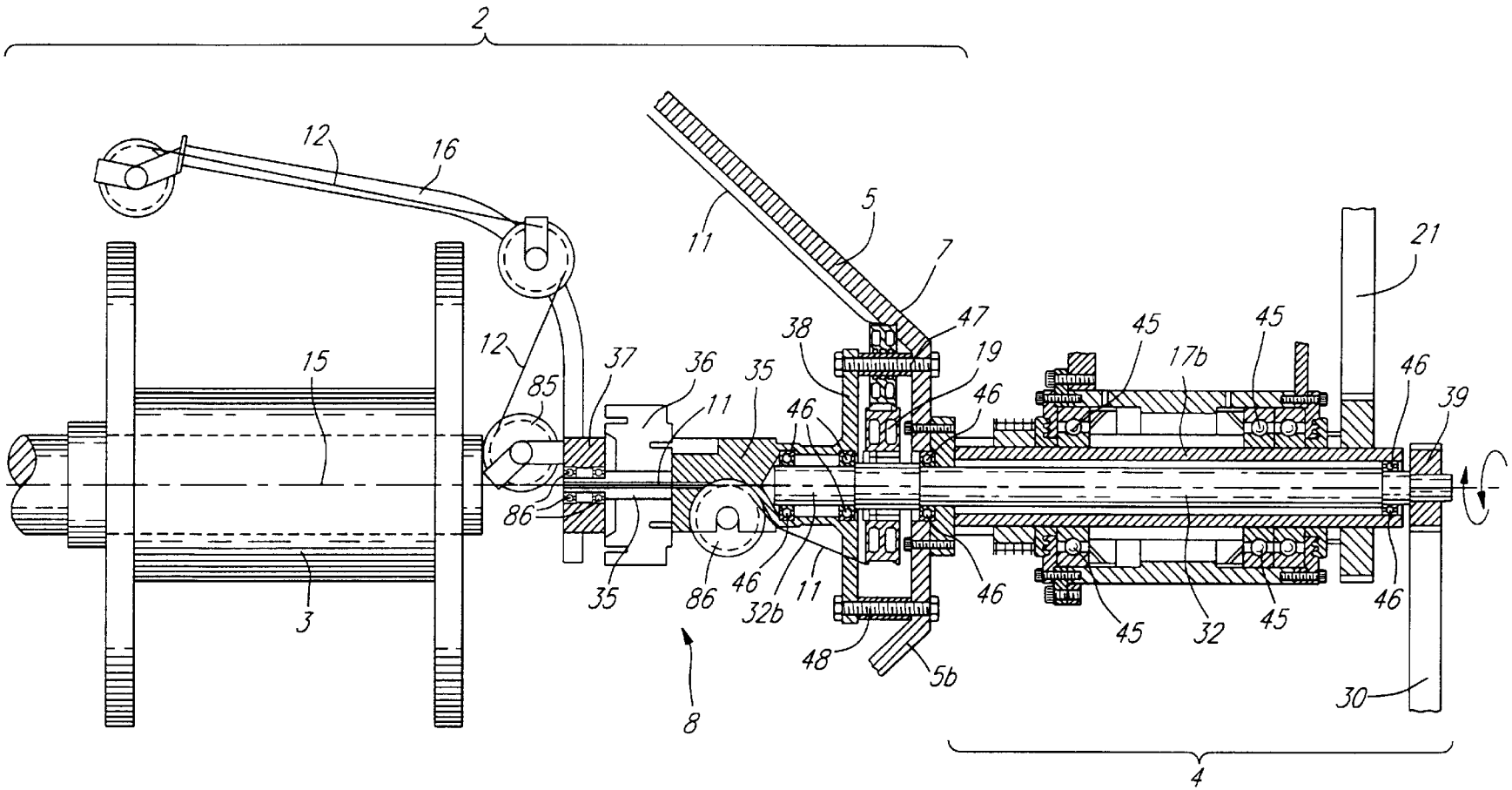
FIG. 4 is a close up of schematic illustration of a modified embodiment a driving means.

FIG. 4 is a close up modified schematic illustration of a driving means of the present invention. Thus as may be seen, there is provided for first twist means generally indicated at 2, comprising arcuate arm member 5 and second twist means 8. The arcuate arm member 5 is rotatable about common axis 15, such that it may define a first space volume as hereabove explained. In addition, there is provided for advancing means generally indicated at 4, which comprises a capstan 19. The capstan 19 is encompassed by the first space volume defined by the arcuate arm member 5. The capstan 19 is affixed to the capstan shaft 32, which capstan shaft 32 has an end portion 32(*b*) which projects beyond the capstan 19. The capstan shaft 32 is operatively connected to the drive belt 30 through pulley 39. The drive belt 30 is operationally connected to motor 31 (not shown). Arcuate arm member 5 is supported on arcuate arm member sleeve shaft 17(*b*), which said arcuate arm member sleeve shaft 17(*b*) is supported on machine frame (not shown) through a number of suitable bearings 45. Arcuate arm member sleeve shaft 17(*b*) is thus rotatable by drive belt 21, which is in turn driven by motor, via connecting shaft 22 and belt 23. However, arcuate arm member sleeve shaft 17(*b*) is not axially displaced. Thus, the arcuate arm member sleeve shaft 17(*b*) may be rotated about common axis 15 and in the process, rotates the arcuate arm member 5, by the arcuate arm member 15 being suitably connected to the arcuate arm member sleeve shaft 17(*b*) through suitable means.

As may be seen, capstan shaft 32 is configured and disposed within the hollow arcuate arm member sleeve shaft 17(*b*) as shown. The axis of rotation of capstan shaft 32 and arcuate arm member sleeve shaft 17(*b*) are substantially coaxial with each other, and with common axis 15. Capstan shaft 32 is thus rotated about its axis within the hollow of arcuate arm member sleeve shaft 17(*b*). There is provided with between arcuate arm member sleeve shaft 17(*b*) and capstan shaft 32 a suitable number and type of bearings 46, which allow the rotation of the capstan shaft 32 within the arcuate arm member sleeve shaft 17(*b*). Thus the capstan shaft 32 and the arcuate arm member sleeve shaft 17(*b*) are in a spaced apart relationship, such that each may rotate about its axis without touching the other.

The second twist means generally indicated at 8 comprises a second twist shaft 35, which is coaxially aligned with the common axis 15. The second twist shaft 35 is operationally connected to the arcuate arm member sleeve shaft 17(*b*) through the connecting plate 38, said connecting plate 38 being operationally connected to the arcuate arm member sleeve shaft 17(*b*) through the use of fixation means, such as bolts 47 and 48 and other suitable means. As may be seen in FIG. 4, second twist shaft 35 is engaged to the end portion 32(*b*) through suitable bearings 46 such that no rotational motion may be imparted thereby, yet end portion 32(*b*) partially supports second twist shaft 35. As previously explained, a Hysteresis™ brake 36 is provided, which said Hysterisis comprises two components, a first outer component and a second inner component affixed to the first outer component such that the second inner component is rotatable in relation to the first outer component. The first outer component of the Hysterisis brake may be affixed to the distal end of the second twist shaft 35, such that a portion of said distal end of said second twist shaft also connect to and engages second outer component. On the opposed side of the Hysteresis brake 36, i.e. on the second inner component, there may be affixed the third twist shaft 37. Thus as may be seen, the axis of rotation of second twist shaft 35 and third twist shaft 37 are substantially coaxially aligned with each other and with common axis 15. Tension flyer 16 is affixed onto the third twist shaft 37, and as may be seen, said third twist shaft 37 is engaged with second twist shaft 35 through bearings 86.

Second twist means 8 imparts the second twist onto intermediate wire 11 being advance therethrough, between pulleys 85 and 86. The Hysterisis brake causes the third twist shaft 37 to rotate at a lower speed that the second twist shaft 35. As intermediate wire 11 is advanced between said pulleys 85 and 86, the difference in the rotational speed between the third twist shaft 37, and pulley 85 attached thereon and second twist shaft 35 and pulley 86 attached thereon will impart a twist onto intermediate wire 11.

As may be seen, first twist means 2 may be provided with an optional counter balance arm partially shown at 5(*b*) opposite the arcuate arm member 5. Said optional counter balance arm 5(*b*)may not be provided in all embodiments of the present invention. The purpose of optional counter balance arm 5(*b*) is to provide a balance to the arcuate arm member 5 such that the rotation of arcuate arm member 5, especially at high velocity may not un-balance or destabilize the apparatus 1.

Figure 5:
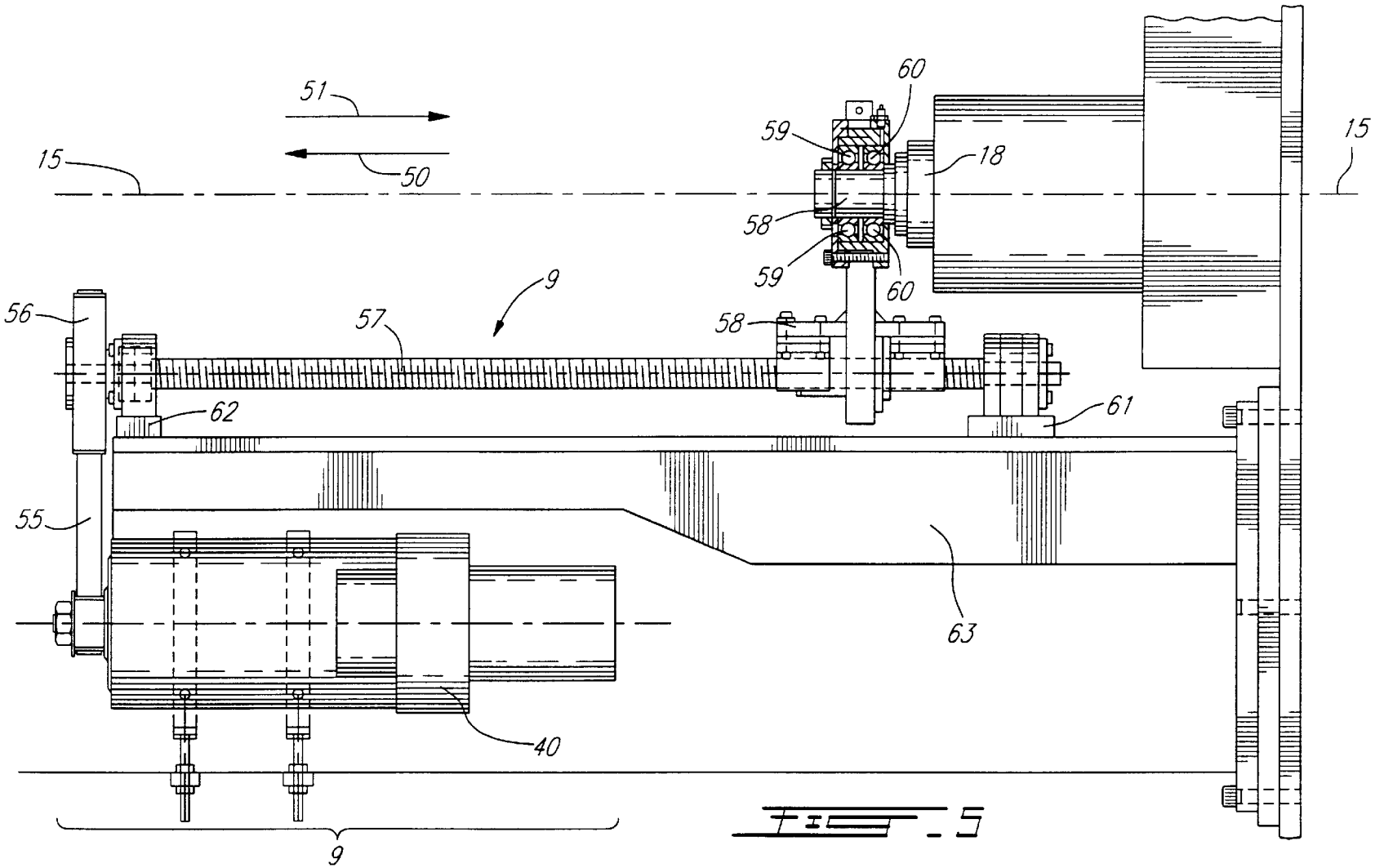
FIG. 5 is a close up schematic illustration of a modified embodiment of a reciprocating means.

FIG. 5 is a close up schematic illustration of the reciprocating means 9 of a modified embodiment of the present invention. Thus as may be seen, there is provided for reciprocating means generally depicted at 9. There is shown a reversible speed electric motor 40, said reversible speed electric motor 40 being shown in an alternative configuration to the position as shown in FIGS. 1 through 3. Reciprocating means 9 also includes a ball screw means generally indicated at 57, said ball screw means being operatively connected to reversible speed electric motor 40 through drive belt 55 and through drive pulley 56. The ball screw means 57 is shown attached to the machine frame (shown partially at 63) through pillow blocks 61 and 62, said pillow blocks containing appropriate bearing, bushing's or other anti friction means (not shown). The ball screw means 57 also comprises carriage unit 58 which is operatively connected to ball screw means 57 such that said carriage unit 58 is supported and displaced by said ball screw means 57. Said carriage unit 58 is operatively connected to shaft 18 through bearings 59 and 60, such as to allow shaft 18 to rotate about axis 15, yet not induce any rotational movement in said carriage unit 58.

Thus, as may be understood, in use, the reciprocating means 9 may be activated by the reversible speed electric motor 40. When reversible speed electric motor 40 is activated and rotates (whether in one direction or the other), it induces the drive belt 55 to rotate in the given direction. The drive belt 55 in turn rotates pulley 56 in the given direction, which in turn induces the ball screw means 57 to be rotated. The rotation of the ball screw means 57 causes the displacement of the carriage unit 58, in a direction which is governed by the direction of rotation of reversible speed electric motor 40. As may be seen, the direction of rotation of reversible speed electric motor 40 in one direction will cause the carriage unit 58 to be displaced in the direction of motion arrow 50. Once carriage unit 58 has been displaced the required or desired distance along motion arrow 50, a limit switch such as a Seimens Proximity Sensor™ or other control or sensing device (not shown) will be activated in a known manner which will cause a signal to be sent to the reversible speed electric motor 40, causing the reversible speed motor 40 to stop rotating in that direction and to reverses its direction of rotation. The driving of the reversible speed motor 40 in the opposite direction will now cause the carriage unit 58 to be displaced along motion arrow 51 by the above described mechanism operating in the reverse direction. As carriage unit 58 is operatively connected to shaft 18, said shaft 18 will also be axially reciprocatingly displaced along motion arrows 50 and 51. Thus the axially reciprocating movement of the carriage unit 58, both along motion arrow 50 and motion arrow 51 will causes an identical or substantially identical axially reciprocating movement of the shaft 18. Shaft 18 will therefore correspondingly be axially reciprocatingly displaced in the direction indicated by motion arrows 50 and 51.

Figure 6:
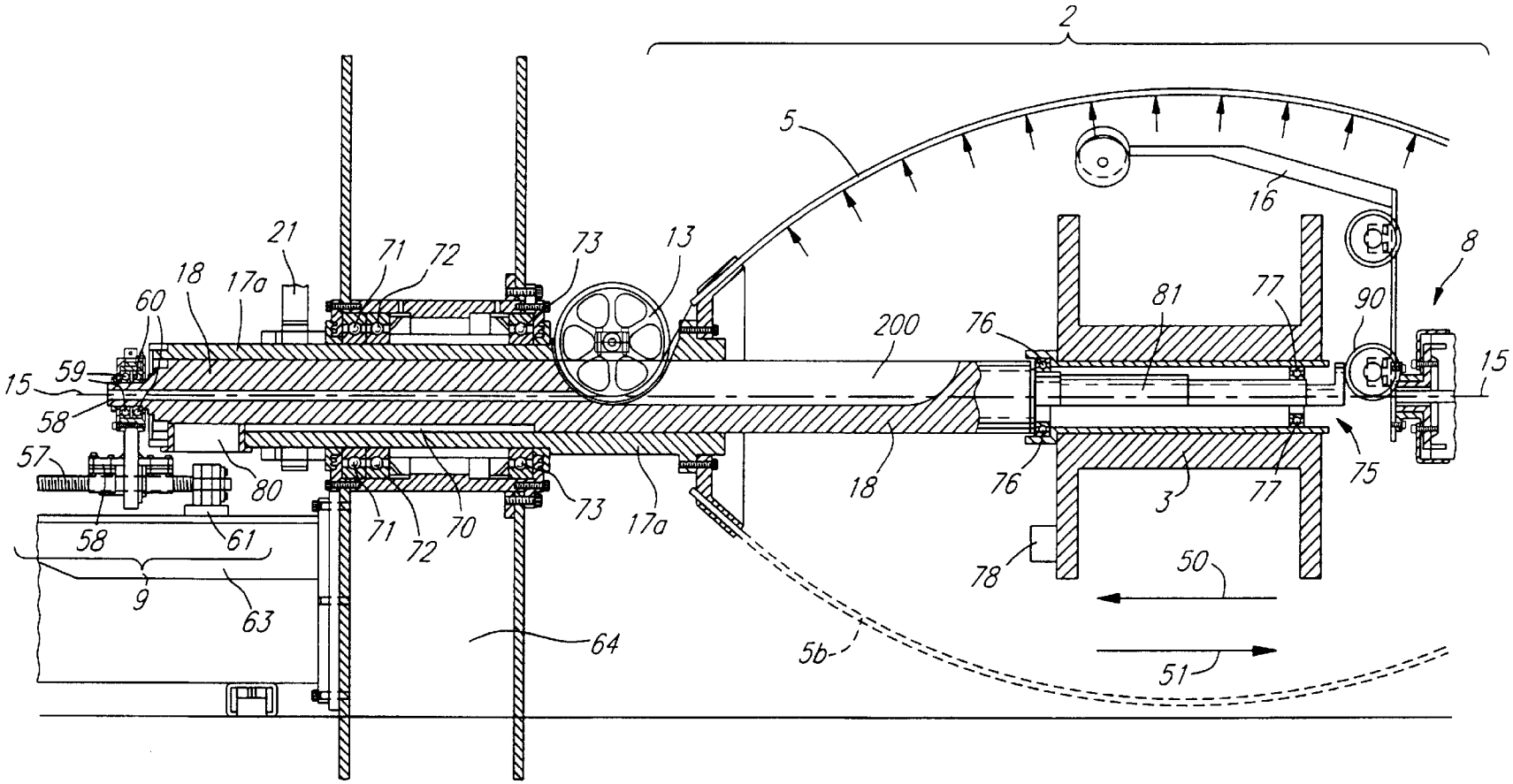
FIG. 6 is close up schematic illustration of a modified embodiment of a reciprocating means and of a take up spool.

FIG. 6 is a further close up schematic illustration of a reciprocating means 9 of a modified embodiment of the present invention showing the relation between the shaft 18 and the rest of reciprocating means 9. There is shown the first twist means, generally defined at 2 comprising the arcuate arm member 5 and the second twist means 8. In addition tension flyer 16 having a modified shape, is shown without any twisted wire thereon. Arcuate arm member sleeve shaft 17(*a*) is shown being supported on machine frame (shown partially at 64) by a plurality of suitable bearing means, namely 71, 72, and 73. Arcuate arm member sleeve shaft 17(*a*) is rotatable about axis 15 by the action of drive belt 21, which is in turn driven by motor 24 (not shown, see FIG. 1). Arcuate arm member sleeve shaft 17(*a*) is rotatable about axis 15, yet is not axially displaceable, either in direction 50 nor direction 51. As may be seen from FIG. 6, arcuate arm member sleeve shaft 17(*a*) is hollow. Shaft 18 is shown as being configured and disposed within the hollow of arcuate arm member sleeve shaft 17(*a*). Therefore shaft 18 slidingly engages the inner walls of arcuate arm member sleeve shaft 17(*a*). Key slot 70 which is slidably engaged by key 80, act together so as to fix shaft 18 and arcuate arm member sleeve shaft 17(*a*) together such that the rotational movement of arcuate arm member sleeve shaft 17(*a*), as driven by drive belt 21, also causes the rotational movement of the shaft 18. Thus arcuate arm member sleeve shaft 17(*a*) and shaft 18 are rotated at the same rotational velocity. As may be seen, the fit between arcuate arm member sleeve shaft 17(*a*) and shaft 18 is such that shaft (18) is supported, at least in part, both in shear and in bending moment by the arcuate arm member sleeve shaft 17(*a*).

Shaft 18 is axially reciprocatingly displaced by the reciprocating means, generally indicated at 9, in the direction of motion arrows 50 and 51, the whole as previously described. Carriage unit 58, being operationally connected to ball screw means 57, is also operationally connected to the shaft 18 through the use of bearings 59 and 60 as well as suitable anchor plate (not shown), such that the shaft 18 may rotate about axis 15, yet not impart any rotation to the carriage unit 58. Thus as carriage unit 58 is axially reciprocatingly displaced in the direction of motion arrows 50 and 51, it also pushes or pulls along, depending on the direction of motion, the shaft. Thus as may be understood, shaft 18 is rotated about axis 15 by being imparted with rotational speed by the arcuate arm member sleeve shaft 17(*a*), through being keyed by key 70, and is also axially reciprocatingly displaced by the carriage unit 58 of the reciprocating means 9.

As explained, shaft 18 is rotatable about axis 15, yet the take up spool 3 which as shall be explained below is rotatably mounted at an end thereof, is not to be imparted with any rotational or any significant rotational movement by shaft 18. Take up spool 3 may be removably mounted on the mounting shaft 75 as described below. Mounting shaft 75 is in turn mounted onto spooling shaft 81 through the use of bearing means 76 and 77. Said spooling shaft 81 is in turn fixedly connected to said shaft 18, such that spooling shaft 81 is rotatable about axis 15 by the rotational movement of shaft 18. Said bearing means 76 and 77 do not impart any rotational movement to the mounting shaft 75 from the spooling shaft 81, therefore it may be seen that shaft 18 and spooling shaft 81 may rotate, yet the mounting shaft 75 and the take up spool 3 will not be rotated by the rotation of shaft 18.

However, mounting shaft 75 is to be mounted onto spooling shaft 81 such that axially reciprocating movement along motion arrows 50 and 51 is imparted to the take up spool 3. Thus the axially reciprocating movement of the reciprocating means generally depicted at 9, and as described herein above, causes the axially reciprocating movement of shaft 18, spooling shaft 81, the mounting shaft 75 and the take up spool 3. It is understood that if required or desired, mounting shaft 75 may be omitted and that take up spool 3 may be mounted directly onto shaft 18 with suitable modification. In addition, the take up spool 3 may be fitted with an appropriate weight 78, which may act as a counter weight. Said counter weight may act as a tension control means to control the tension in twisted wire 12'.

Shaft 18 comprises a groove or slot 200 sized and configured to receive therein pulley 13 when shaft 18 is axially displaced.

FIG. 7 is a schematic longitudinal sectional view of a take up spool showing a means of attachment of the take up spool onto the spooling shaft. The take up spool 3 is rotationally mounted directly onto spooling shaft 81. Spooling shaft 81 is shown having an edge 90 at the distal end of said spooling shaft 81. The bearings 76 an 77 are shown. Take up spool 3 is removed from the spooling shaft 81 by being lifted up in the direction of motion arrow 91, followed by a forward movement along motion arrow 92. The take up spool 3 must be lifted by a distance greater than shown at 93 in order to be clear from edge 90, so as to be removed.

Figure 8:
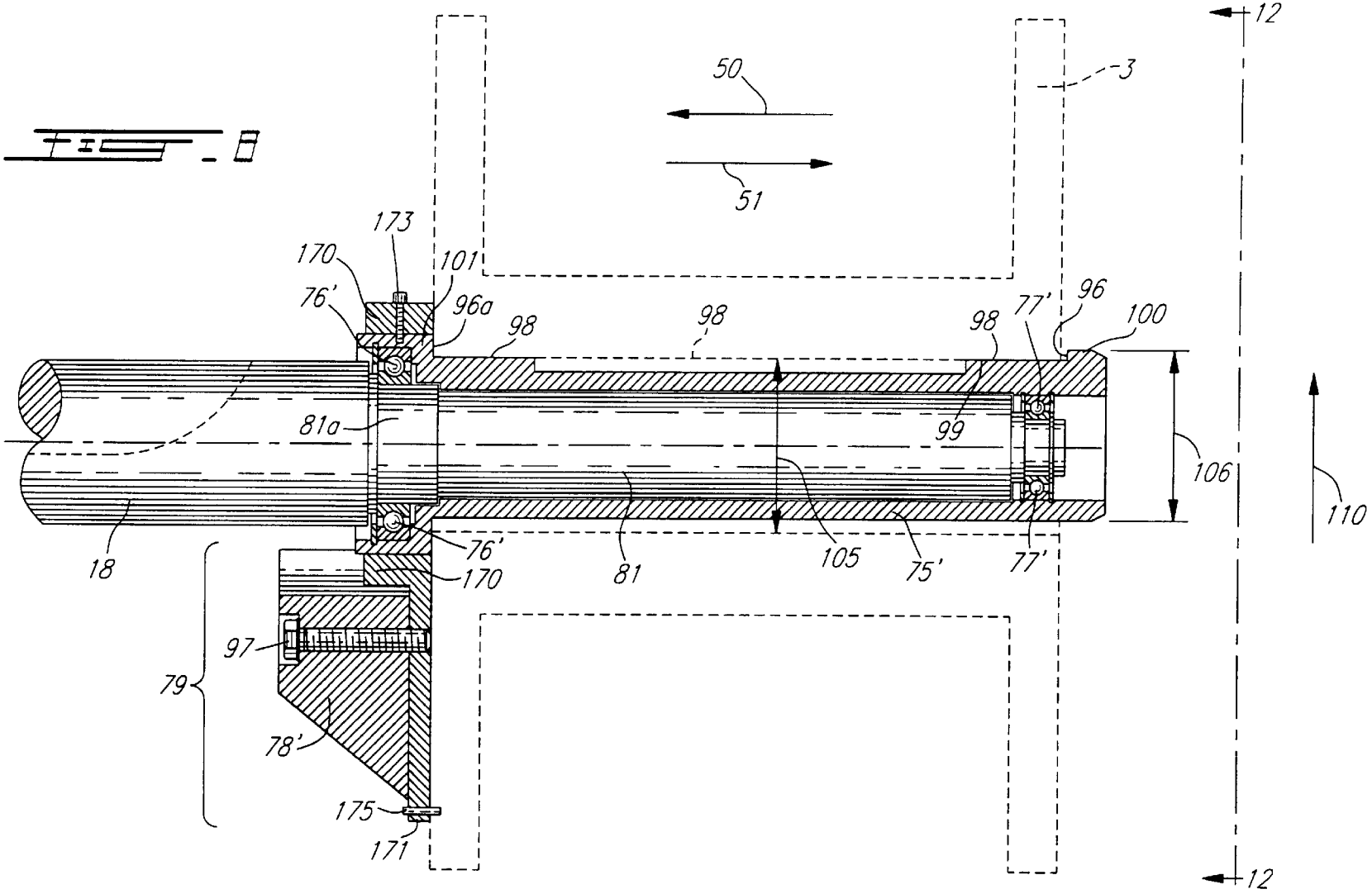
FIG. 8 is a detailed schematic view of the attachment of the take up spool shown in FIG. 7.

FIG. 8 is a detailed schematic view of the attachment of the take up spool 3 as shown in FIG. 7. Take up spool 3 is shown to be removably mounted onto, and rests on mounting shaft 75', and is held in place, in part, through the pull of gravity. Mounting shaft 75' and take up spool 3 are configured and their material of construction are selected so that contact between surface 98 of the take up spool 3, and surfaces 99 of the mounting shaft 75' creates frictional resistance to relative movement therebetween. Mounting shaft 75' further comprises a lip 100 at its distal extremity, which lip 100 serves as a stop-gap to inhibit take up spool 3 from falling off mounting shaft 75', for example, when the machine is in operation. As shown in FIG. 8, take up spool 3 is disposed on mounting shaft 75' such that there is a gap between lip 100 and edge 96, and conversely, such that opposed end 96(*a*) of take up spool 3 abuts shoulder 101 of mounting shaft 75'. It is understood however, that this configuration may be reversed, or alternatively, that take up spool may not be in contact with either lip 100 or shoulder 101. Although not shown, take up spool 3 may be removably, fixedly, connected to the mounting shaft 75', through the use of any known means, such as a locking pin, screw, bracket, etc . . . as required or desired.

Mounting shaft 75' is mounted on the spooling shaft 81 through, inter alia, the use of anti friction means, namely forward bearing 77' and rear bearing 76'. As explained above, e.g. with respect to FIGS. 1 to 3, spooling shaft 81 may be imparted with rotational movement through shaft 18. However, the presence of bearing 77' and 76' means that rotational movement of mounting shaft 75' will be minimized or essentially eliminated. Thus as may be understood, when spooling shaft 81 is rotated, no rotational movement (or substantially no rotational movement) will be transmitted to mounting shaft 75 because of the presence of bearings 76' and 77'. Consequently, take up spool 3 will also not rotate in relation to the (rotating) spooling shaft 81.

Figure 11:
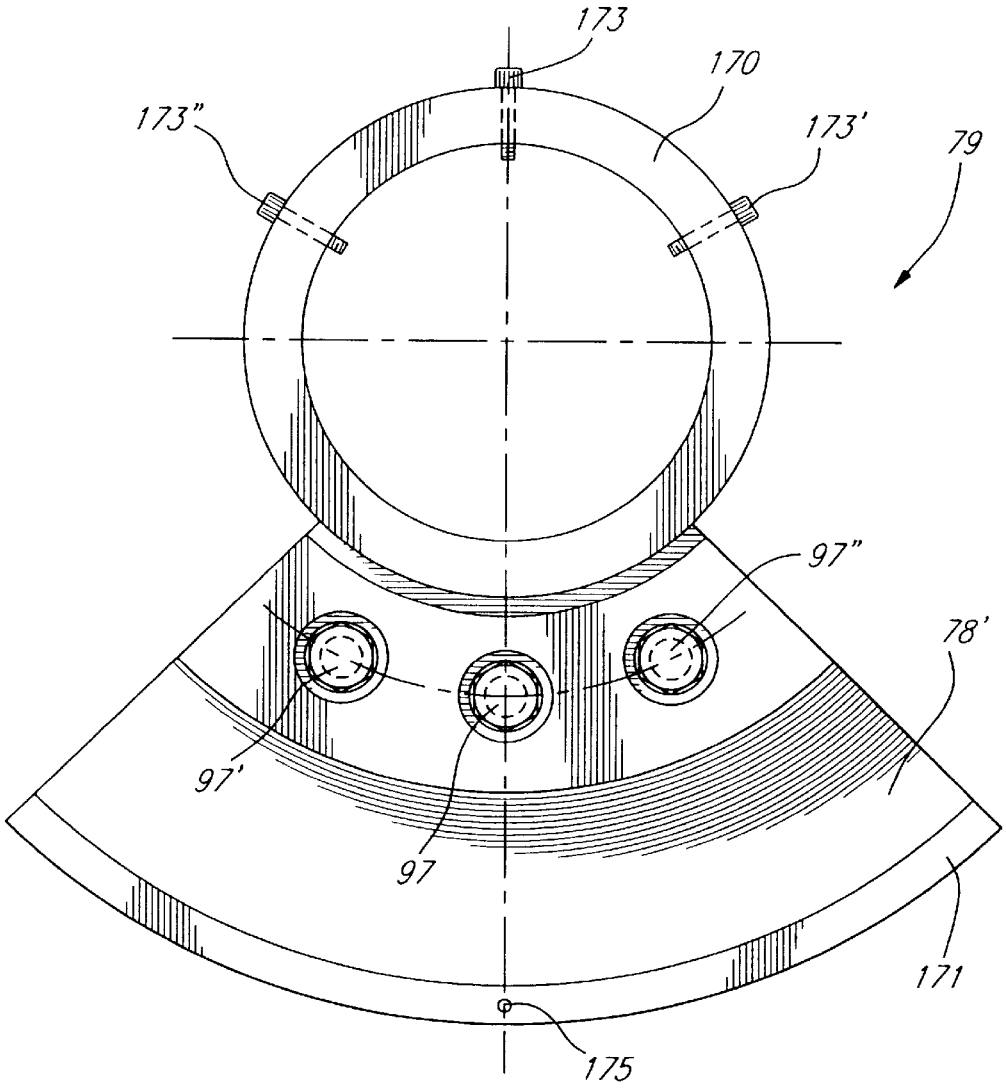
FIG. 11 is a front elevation view of the counterweight means shown unmounted onto the mounting shaft, shown along view lines 11—11 of FIG. 10.

It is understood however, that bearings 76' and 77' can not be 100% friction less, and may therefore transmit some small rotational force from the spooling shaft 81 to the mounting shaft 75'. In addition, the wounding of the twisted wire 14 onto the take up spool 3 (as shown in FIGS. 1 to 3) may cause some rotational force to be transmitted to the take up spool 3 by the twisted wire itself (not shown). Therefore, to counteract (undesirable) rotational forces, if any, the mounting shaft 75' may be fitted with a suitable counter weight means, generally designated by reference number 79. Counterweight means 79 may be configured and disposed to counter (undesirable) rotational forces which may be imparted to mounting shaft 75' and/or on take up spool 3. Counter weight means 79 may, for example, comprise a support plate 171 comprising a support ring 170. Support ring 170 engages on, and fits over the mounting shaft 75', and is releasably connected to the mounting shaft 75 through fixation means 173, such as for example, a pin, set screw, etc . . . (as also shown in FIG. 11). A counterweight 78' may be removably connected to the support plate 171 through the use of fixation means 97, such as for example, a bolt. Counter weight 78' is to be of sufficient mass such that if mounting shaft 75' and/or take up spool 3 are subjected to rotational force, the mass of the counterweight 78' may counteract said rotational force and keep the take up spool 3 and mounting shaft 75' substantially rotationless in relation to spooling shaft 81.

In order to further ensure that take up spool 3 remains rotationally fixed in relation to the mounting shaft 75', take up spool 3 may also be releasably connected to the counterweight means 79 through the use of a fixation means 175, such as for example, a blocking pin, screw, bracket, etc . . .

Take up spool 3 may be removed from the mounting shaft 75' by being lifted through suitable means, in the direction of motion arrow 110, such that edge 96 of take up spool 3 may clear lip 100 of mounting shaft 75'. Once edge 96 of take up spool 3 has cleared lip 100, a further movement may be imparted to take up spool 3 in the direction of motion arrow 111, such that take up spool 3 may be moved clear of the mounting shaft 75'. As may be understood, in order to effect the removal of the take up spool 3, the diameter 105 of the core of take up spool 3 is to be greater than the overall diameter 106 of mounting shaft 75'.

Figure 9:
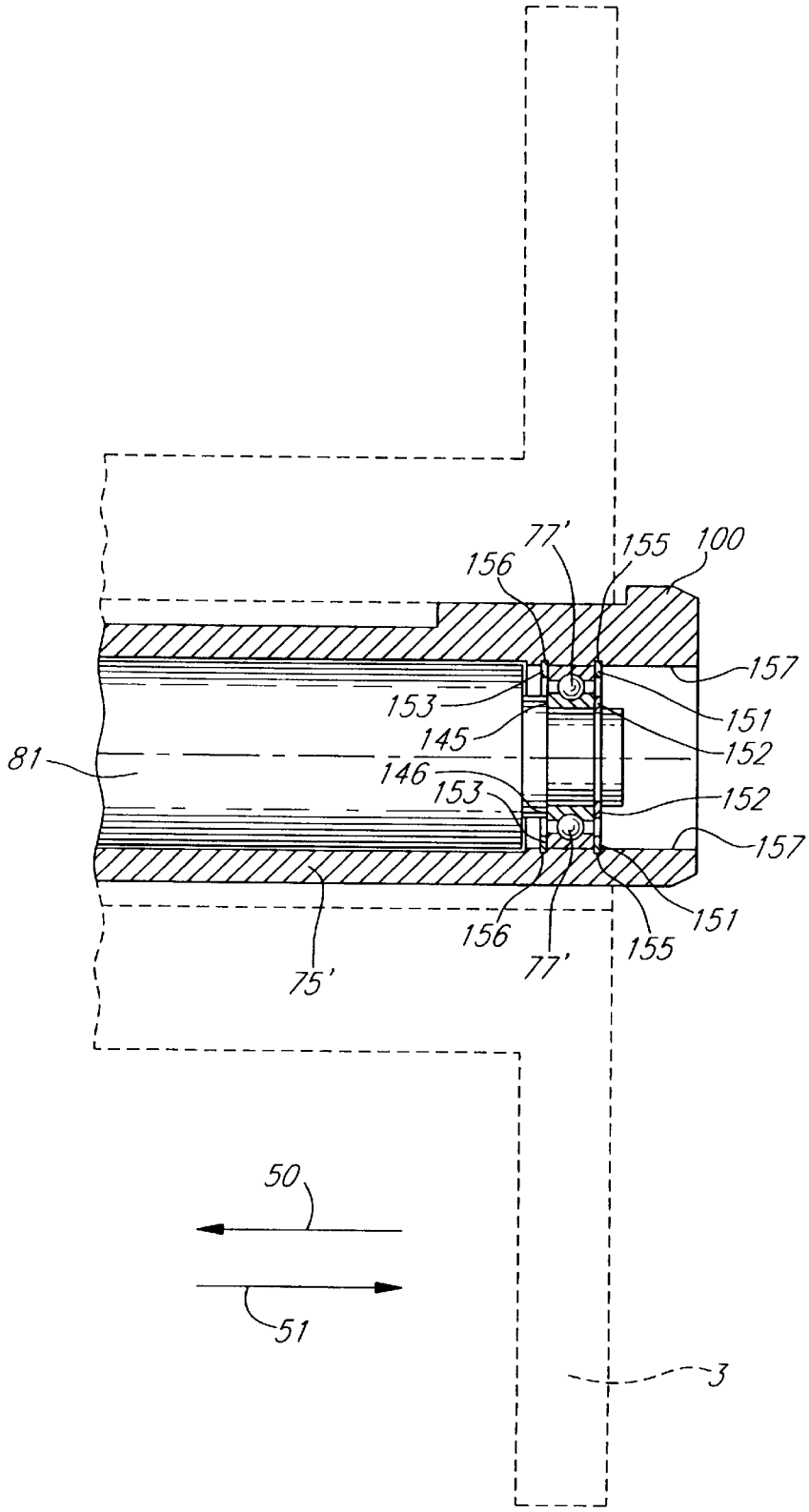
FIG. 9 is a close-up view of the forward end of spooling shaft showing in greater detail forward bearing connecting mounting shaft to the spooling shaft, as shown in FIG. 8.

FIG. 9 is a close-up view of the forward end of spooling shaft 81 showing in greater detail forward bearing 77' connecting the mounting shaft 75' to the spooling shaft 81 as shown in FIG. 8.

Bearing 77' is mounted in such a manner so as to allow for the transfer of translational force between the spooling shaft 81 and mounting shaft 75', i.e. in the direction of motion arrows 50 and 51, without transferring rotational forces therebetween. Forward bearing 77' may be of any known type, and as shown, comprises a ring bearing which is disposed so as to ring the distal end of spooling shaft 81. Although shown as a ring bearing, bearing 77' may be of any other suitable type.

More particularly, spooling shaft 81 is shown having at its forwardmost end a number of narrowing, concentric steps, which define therebetween shoulders 145 and 146 onto which forward bearing 77' abuts. Bearing 77' is held in place between spooling shaft 81 and mounting shaft 75' by circlips (also known as c-rings or snap-rings) 151, 152 and 153. Circlips 151 and 153 are disposed on opposed sides of bearing 77, and circlip 152 is disposed forward of bearing 77'. The arrangement of circlips 151, 152, and 153 is such that bearing 77' is held in place against shoulders 145 and 146.

The transfer of translational forces between the spooling shaft 81 and the mounting shaft 75' is accomplished, in part, by the combined actions of shoulders 145 and 146 and circlips 151, 152, and 153 acting on forward bearing 77'. Thus when spooling shaft 81 is displaced in the direction of motion arrow 51, shoulders 145 and 146 push against bearing 77', which causes bearing 77' to transmits translational force to circlip 151. This translational force is then transferred to mounting shaft 75', which consequently is also displaced in the direction of motion arrow 51.

When spooling shaft 81 is displaced in the opposite direction, i.e. in the direction of motion arrow 50, spooling shaft 81 pulls on circlip 152. Circlip 152 then pushes against bearing 77', causing bearing 77' to transmits translational force to circlip 153. This translational force is then transferred to mounting shaft 75', which consequently is displaced in the direction of motion arrow 50.

As may be seen, circlips 151 and 153 are disposed within grooves 155 and 156 disposed on the surface of the inside diameter 157 of mounting shaft 75'. Circlip 151, 152 and 153 are to be of a suitably resilient material, such as for example, steel. Circlips 151 and 152 are to be installed in a manner such that when compressed inwardly, they will deform to fit into a groove (such as grooves 155 and 156) and when released, will spring back and clip firmly into place within said groove. Inversely, C-ring 152 will, when pulled outwardly, deform to fit over the distal end of spooling shaft 81, and when released will spring back and firmly clasp in place.

Figure 10:
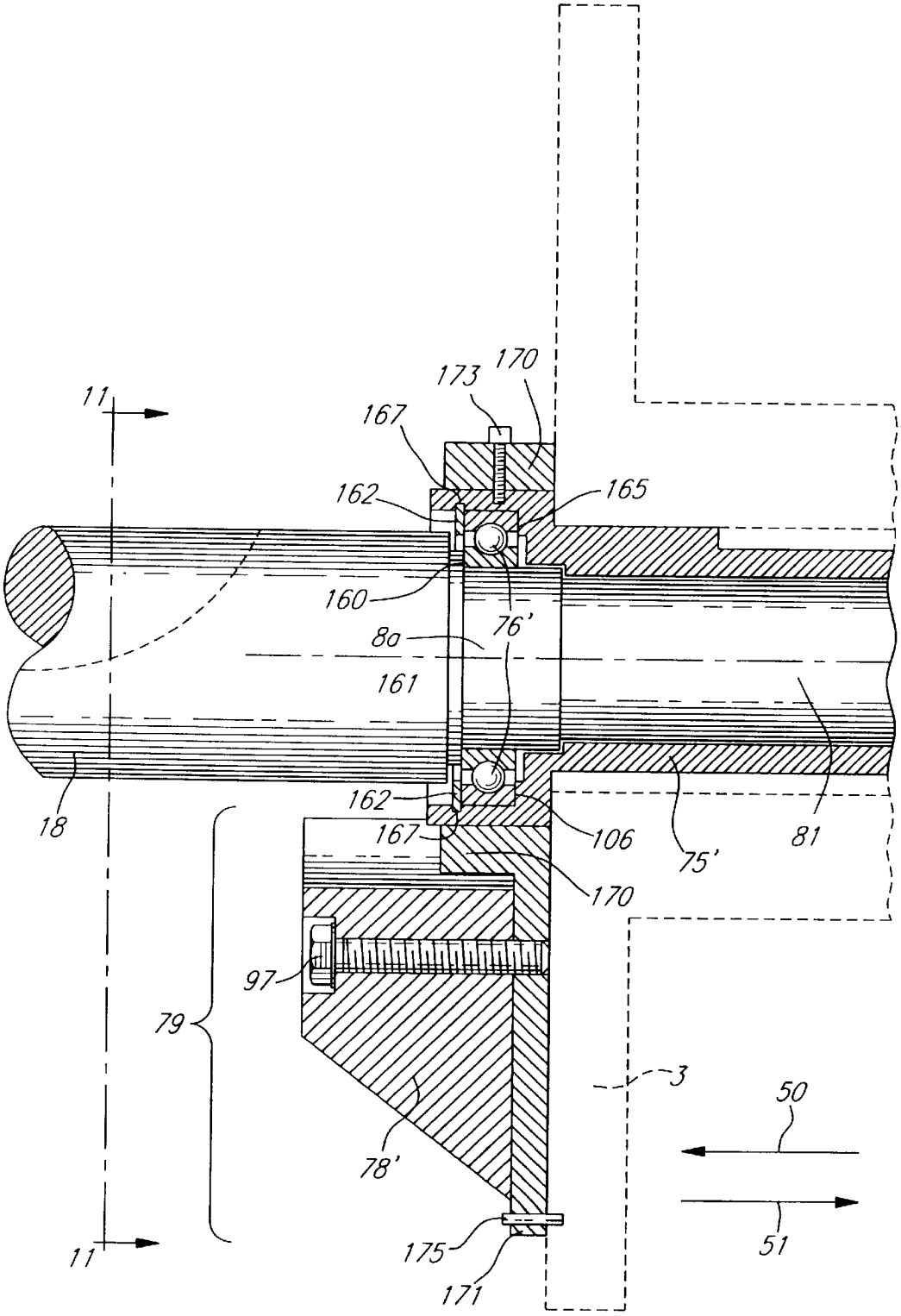
FIG. 10 is a close-up view of the rearward end of spooling shaft showing in greater detail the rear bearing connecting mounting shaft to spooling shaft, as shown in FIG. 8.

FIG. 10 is a close-up view of the rearward end of spooling shaft 81 showing in greater detail the rear bearing 76' connecting mounting shaft 75' to spooling shaft 81 as shown in FIG. 8.

As explained with respect to forward bearing 77', bearing 76' is mounted in such a manner so as to allow for the transfer of translational force between the spooling shaft 81 and mounting shaft 75', i.e. in the direction of motion arrows 50 and 51, without transferring rotational forces therebetween. Also, rear bearing 76' may be of any known type, and as shown, comprises a ring bearing which is disposed so as to ring end 81(*a*) of spooling shaft 81. Although shown as a ring bearing, bearing 76' may also be of any other suitable type.

Spooling shaft 81 is shown having at end 81(*a*) a number of narrowing concentric steps, which define therebetween shoulders 160 and 161 onto which rear bearing 76' abuts. Mounting shaft 75' also comprises shoulders 165 and 166, which also abut bearing 76'. Bearing 76' is held in place between spooling shaft 81 and mounting shaft 75' by circlip 162, and therefore abuts shoulders 160, 161 and shoulders 165 and 166.

The transfer of translational forces between shaft 18 and the mounting shaft 75' is accomplished, in part, by the combined action of shoulders 160, 161 and shoulders 165 and 166, as well as circlip 162 acting on bearing 76'. Thus when spooling shaft 81 is displaced in the direction of motion arrow 51, shoulders 160 and 161 push against bearing 76', which causes bearing 76' to transmits translational force to shoulders 165 and 166 of mounting shaft 75', causing mounting shaft 75' to be displaced in the direction of motion arrow 51.

When spooling shaft 81 is displaced in the opposite direction, i.e. in the direction of motion arrow 50, spooling shaft 81 does not directly transfer translational forces to rear bearing 76. Rather, it is the translational forces acting on circlip 152 (as shown in FIG. 9) which cause mounting shaft 75', to be displaced in the direction of motion arrow 50, and cause shoulders 165 and 166 to push against bearing 76'.

As may be seen, circlip 162 is disposed within groove 167. As explained above with respect to circlips 151, 152, and 153, circlip 162 is also to be of a suitably resilient material, such as for example, steel.

FIG. 10 further shows counterweight means generally indicated by reference number 79, comprising a support plate 171 comprising a support ring 170. Support ring 170 is engaged on and fits over mounting shaft 75, and is releasably affixed thereto by a fixation means, such as bolt 173', as further described in FIG. 11. Support plate 171 is also fitted with a counterweight 78' which is removably affixed to support plate 171 through fixation means 97.

FIG. 11 is a front elevation view (along view lines 11—11 of FIG. 10) of the counterweight means 79 shown unmounted onto mounting shaft 75'. Counterweight means 79 comprises the support plate 171 having the support ring 170 configured and disposed so as to be able to releasably engage and fit over mounting shaft 75' (as shown in FIG. 10). Support ring 170 comprises fixation means 173, 173', and 173", shown for example, as pins or set screws, which may be used to secure the support ring 170 to mounting shaft 75' (as shown in FIGS. 8 and 10). Counterweight means 79 further comprises counterweight 78' shown affixed to support plate 171 through fixation means 97, 97' and 97", such as for example bolts, the heads of which are shown. Support plate 171 is additionally provided with fixation means 175, such as for example, locking pin, screw, bracket, etc . . . which may affix the counterweight means 79 to the take up spool 3, as shown in FIGS. 8 and 10.

Figure 12:
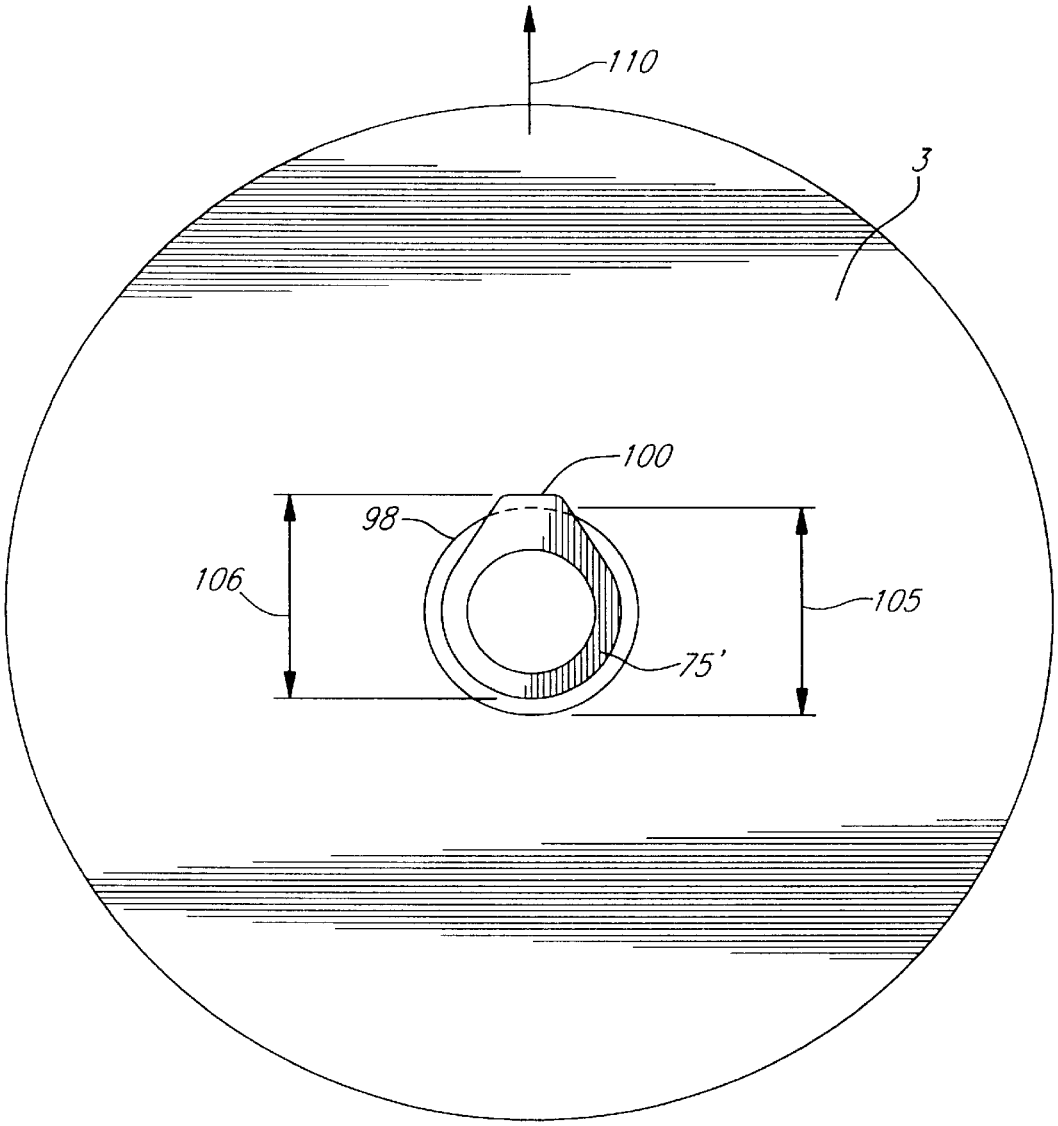
FIG. 12 is end on elevation view of the take up spool along view lines 12—12 of FIG. 8.

FIG. 12 is an elevation end view of take up spool 3 along view lines 12—12 of FIG. 8. Details of forward bearing 77' (as shown in FIGS. 8 and 9) have been omitted. Take up spool 3 is shown to be removably mounted onto mounting shaft 75'. Referring to FIGS. 8 and 12, surface 99 of mounting shaft 75' engages surface 98 of take up spool 3. Mounting shaft 75' is shown having lip 100, which lip 100 is configured and disposed to act as a stop-gap to inhibit take up spool 3 from falling of mounting shaft 75'.

As may be understood, in order to remove take up spool 3 from mounting shaft 75', take up spool is to be lifted in the direction of motion arrow 110. When surface 98 clears the top of lip 100, the take up spool may then be displaced in the direction of motion arrow 111 (as shown in FIG. 8) i.e. in the direction coming out of the page, towards the viewer. Thus, in order to effect the removal of take up spool 3, the diameter of the 105 of the core of take up spool 3 must be larger than overall diameter 106.

I claim:

1. In an apparatus for making twisted wire from a plurality of feed wires being advanced therethrough, said apparatus comprising twisting means for imparting at least one twist to said plurality of feed wires so as to obtain said twisted wire, means for taking up said twisted wire onto a take up spool such that said twisted wire is wound thereabout, said take up spool having a longitudinal axis, the improvement wherein said take up spool is reciprocatingly displaceable along said longitudinal axis, and wherein said take up spool is not rotatably driven, wherein said apparatus includes reciprocating means for inducing a reciprocating movement of said take up spool along said longitudinal axis when said twisted wire is taken up onto said take up spool.

2. An apparatus as defined in claim 1 wherein said twisting means is configured for imparting at least 2 twists to said plurality of feed wires.

3. The apparatus as defined in claim 2 wherein said apparatus comprises wire advancing means for advancing said plurality of feed wires through said apparatus.

4. The apparatus as defined in claim 2 wherein said twisting means imparts a first twist followed by a second twist to said feed wires in order to obtain a double twist wire, said twisting means comprising a first twist means for imparting said first twist to said plurality of feed wires, said first twist means comprising a twist component being rotatable about a first axis so as to define a space-volume, and a second twist means for imparting said second twist to said plurality of feed wires subsequent to said first twist, said take up spool being configured and disposed so as to be encompassed within said space-volume.

5. The apparatus as defined in claim 1 wherein said apparatus comprises wire advancing means for advancing said plurality of feed wires through said apparatus.

6. In an apparatus for making twisted wire from a plurality of feed wires, said apparatus comprising wire advancing means for advancing said plurality of feed wires through said apparatus, twisting means for imparting at least one twist to said plurality of feed wires, said twisting means comprising a first twist component being rotatable about a first axis such as to define a space volume, means for taking up said twisted wire onto a take up spool such that said twisted wire is wound thereabout, the improvement wherein said wire advancing means comprises a capstan configured and disposed to be rotatable about a second axis coaxially aligned with said first axis of rotation.

7. An apparatus as defined in claim 6 wherein said twisting means is configured for imparting at least 2 twists to said plurality of feed wires.

8. The apparatus as defined in claim 7 wherein said advancing means comprises a capstan driving means configured and disposed so as to be exterior of said space volume, said capstan driving means being operatively connected to said capstan so as to be able to rotationally drive said capstan.

9. The apparatus as defined in claim 7 wherein said capstan is configured and disposed so as to be encompassed within said space volume.

10. The apparatus as defined in claim 7 wherein said capstan is configured and disposed so as to be encompassed outside of said space volume.

11. The apparatus as defined in claim 6 wherein said advancing means comprises a capstan driving means configured and disposed so as to be exterior of said space volume, said capstan driving means being operatively connected to said capstan so as to be able to rotationally drive said capstan.

12. The apparatus as defined in claim 6 wherein said capstan is configured and disposed so as to be encompassed within said space volume.

13. The apparatus as defined in claim 6 wherein said capstan is configured and disposed so as to be encompassed outside of said space volume.

14. A double twist apparatus for making double twisted wire from a plurality of feed wires, comprising:

wire advancing means for advancing said plurality of feed wires through said apparatus;

first twist means for imparting a first twist to said plurality of feed wires;

second twist means for imparting a second twist to said plurality of feed wires subsequent to said first twist;

take up means for taking up said twisted wire onto a take up spool, such that said twisted wire is wound about said take up spool, said take up spool having a longitudinal axis and being axially reciprocatingly displaceable along said longitudinal axis;

reciprocating means for inducing a reciprocating movement of said take up spool along said longitudinal axis when said twisted wire is taken up onto said take up spool;

said first twist means comprising an arcuate arm member having opposed ends, said arcuate arm member being rotatably mounted at each said opposed end such that said arcuate arm member is rotatable about a common axis so as to define a space volume, said take up means comprising a tension flyer rotatable about a first axis, said first axis being coaxially aligned with said common axis, said take up means being configured and disposed such that said tension flyer is encompassed within said space volume, said take up spool being configured and disposed to be non rotatable about said longitudinal axis when said twisted wire is being taken up onto said take up spool, said wire advancing means comprising a capstan configured and disposed to be rotatable about a second axis coaxially aligned with said common axis, and wherein said advancing means includes capstan driving means operatively connected to said capstan so as to be able to rotationally drive said capstan.

15. An apparatus for taking up wire onto a take up spool having a longitudinal axis, said apparatus comprising means for taking up said wire onto said take up spool such that said wire is wound thereabout, the improvement wherein said take up spool is reciprocatingly displaceable along said longitudinal axis and wherein said take up spool is not rotatably driven wherein said apparatus includes reciprocating means for reciprocatingly displacing said take up spool along said longitudinal axis when said twisted wire is taken up onto said take up spool.

16. A method of winding wire onto a take up spool comprising winding said wire about said take up spool having a longitudinal axis;

reciprocatingly displacing said take up spool along said longitudinal axis in combination with the winding of said wire when said wire is taken up onto said take up spool, wherein said take up spool is not rotationally driven when said wire is taken up onto said take up spool.

17. In an apparatus for making twisted wire from a plurality of feed wires being advanced therethrough, said apparatus comprising wire advancing means for advancing said plurality of feed wires through said apparatus, said wire advancing means comprising a capstan twisting means for imparting at least one twist to said plurality of feed wires so as to obtain said twisted wire, means for taking up said twisted wire onto a take up spool such that said twisted wire is wound thereabout, said take up spool having a longitudinal axis, the improvement wherein said take up spool is configured and disposed to be non rotatable about said longitudinal axis when said twisted wire is being taken up onto said take up spool.

* * * * *